US005118093A

United States Patent [19]

Makiura et al.

[11] Patent Number: 5,118,093

[45] Date of Patent: Jun. 2, 1992

[54] IMAGE-FORMING MACHINE

[75] Inventors: Yoshinori Makiura, Kawachinagano; Tadakazu Ogiri, Takatsuki; Shigeki Hayashi, Ikoma; Naoyuki Ishida, Osaka; Masami Fuchi, Neyagawa; Hiroaki Nakamura, Ikoma; Katsuhide Yamaguchi, Takatsuki; Hiroshi Kubota, Osaka, all of Japan

[73] Assignee: Mita Industrial Co., Ltd., Osaka, Japan

[21] Appl. No.: 661,300

[22] Filed: Feb. 27, 1991

Related U.S. Application Data

[62] Division of Ser. No. 408,275, Aug. 18, 1989, Pat. No. 5,052,670.

[30] Foreign Application Priority Data

Sep. 27, 1988 [JP] Japan ..... 63-239830

[51] Int. Cl.[5] ..... B65H 29/60

[52] U.S. Cl. ..... 271/291; 271/65; 271/213; 271/223; 271/273; 271/301

[58] Field of Search ..... 271/65, 291, 301, 902, 271/240, 213, 273, 274, 223

[56] References Cited

U.S. PATENT DOCUMENTS

| | | | |
|---|---|---|---|
| 3,476,382 | 11/1969 | Tregay | 271/240 |
| 4,066,252 | 1/1978 | Wick . | |
| 4,453,819 | 6/1984 | Wada | 271/902 X |
| 4,456,362 | 6/1984 | Masaki et al. . | |
| 4,492,371 | 1/1985 | Kan et al. . | |
| 4,508,445 | 4/1985 | Izumi . | |
| 4,583,844 | 4/1986 | Honda . | |
| 4,609,281 | 9/1986 | Miyai et al. . | |
| 4,684,235 | 8/1987 | Kohmoto et al. . | |
| 4,733,310 | 4/1988 | Kapp et al. . | |
| 4,750,016 | 6/1988 | Kusumoto et al. . | |
| 4,866,487 | 9/1989 | Ohuchi | 271/291 X |

FOREIGN PATENT DOCUMENTS

| | | |
|---|---|---|
| 0110398 | 6/1984 | European Pat. Off. . |
| 0139223 | 9/1984 | European Pat. Off. . |
| 0204227 | 12/1986 | European Pat. Off. . |
| 0237050 | 9/1987 | European Pat. Off. . |
| 0225546 | 1/1988 | European Pat. Off. . |
| 2112702 | 12/1971 | Fed. Rep. of Germany . |
| 58-125065 | 10/1983 | Japan . |
| 60-67968 | 4/1985 | Japan . |
| 2197258 | 5/1988 | United Kingdom . |

OTHER PUBLICATIONS

Patent Abstracts of Japan, vol. 12, No. 536(M-745) [3203], Sep. 26, 1988 for Japanese Patent No. JP-A-63 112 325.

Patent Abstracts of Japan, vol. 12, No. 356 (M-745) [3203], Sep. 26, 1988 for Japanese Patent No. JP-A-63 112 326.

*Primary Examiner*—Richard A. Schacher

*Attorney, Agent, or Firm*—Beveridge, DeGrandi & Weilacher

[57] ABSTRACT

An image-forming machine having a conveying passage for conveying a sheet material through a transfer zone, a first and a second feed device for feeding the sheet material to the conveying passage, a first feed passage for conducting the sheet material delivered from the first feed device to the conveying passage, a second feed passage for conducting the sheet material delivered from the second feed device to the conveying passage, and a first and a second opening-closing member for opening and closing the first and second feed passages. Various improvements are made on the first and second opening-closing members. Further provided are an improvement for suppressing noises, an improvement for preventing folding of a sheet material, an improvement for easily switching over to a mode of forming an image on both surfaces of a sheet material, an improvement for accurately conducting the sheet material from a reversal holding portion to a return passage, and an improvement for positioning the sheet material received in the receiving-refeeding device at a predetermined width-wise position in the above and other types of image-forming machines.

6 Claims, 20 Drawing Sheets

IMAGE-FORMING MACHINE

This application is a division of application Ser. No. 07/408,275, filed Aug. 18, 1989, now U.S. Pat. No. 5,052,670.

FIELD OF THE INVENTION

This invention relates to an image-forming machine such as an electrostatic copying machine or a laser beam printer.

DESCRIPTION OF THE PRIOR ART

Image-forming machines such as an electrostatic copying machine have been in widespread commercial use.

Conventional image-forming machines, however, have various problems yet to be solved, for example those listed below.

(a) A feed passage for conducting a sheet material delivered from feed means to a conveying passage cannot be sufficiently opened.

(b) When the feed passage is defined by an opening-closing member which is freely openable or closable, it is difficult to ascertain easily and accurately whether the opening-closing member is held at a closing position.

(c) The structure of the machine is complex in relation to locking means for locking the opening-closing member into the closing position.

(d) The sheet material delivered toward the feed passage from the feed means produces noises.

(e) When delivered from the feed means, the sheet material folds at both ends of its leading end portion.

(f) The structure of the machine is complex in relation to the opening-closing member.

(g) The opening-closing member is difficult to hold accurately at the closing position.

(h) A mode in which an image is formed on one surface of the sheet material is difficult to change to a mode in which an image is formed on its both surfaces.

(i) The operation for holding an opening-closing guide member at a closing position is troublesome.

(j) In an auxiliary unit for both surface image-formation to be applied to the main body of the image-forming machine, a sheet material from a reversal holding portion is likely to come into an introduction passage.

(k) In the formation of an image on both surfaces, the structure of the machine is complex in relation to receiving and re-feeding means for receiving a sheer material bearing an image on one surface and refeeding the received sheet material.

SUMMARY OF THE INVENTION

It is a first object of this invention to provide an excellent image-forming machine in which a feed passage for feeding a sheet material to a conveying passage can be sufficiently opened.

A second object of the invention is to provide an excellent image-forming machine in which whether an opening-closing member defining a feed passage is held at a closing position can be ascertained easily and accurately.

A third object of this invention is to provide an excellent image-forming machine in which locking means for locking an opening-closing member into a closing position can be held accurately in a locked state by a relatively simple structure.

A fourth object of this invention is to provide an excellent image-forming machine in which noises produced at the time of delivering a sheet material can be suppressed.

A fifth object of this invention is to provide an excellent image-forming machine in which folding of a sheet material which is liable to occur when it is delivered from feed means can be prevented.

A sixth object of this invention is to provide an excellent image-forming machine in which the structure relating to an opening-closing member is simple.

A seventh object of this invention is to provide an excellent image-forming machine in which an opening-closing member can be accurately held at a closing position.

An eighth object of this invention is to provide an excellent image-forming machine in which a mode wherein an image is formed on one surface of a sheet material can be easily switched over to a mode wherein an image is formed on both surfaces of the sheet material.

A ninth object of this invention is to provide an excellent image-forming machine in which an opening-closing guide member can be held at a closing position by a relatively simple operation.

A tenth object of this invention is to provide an excellent image-forming machine in which a sheet material can be accurately conducted to a returning passage from a reversal holding portion in an auxiliary unit for both surface image-formation.

An eleventh object of this invention is to provide an excellent image-forming machine in which a sheet material received in a receiving-refeeding means can be held at a predetermined position in the width direction.

Other objects and features of this invention will become apparent from the following description.

DETAILED DESCRIPTION OF PREFERRED EMBODIMENTS

The invention will be described in detail with reference to the accompanying drawings.

OUTLINE OF THE LASER BEAM PRINTER AS A WHOLE

Figure 1:
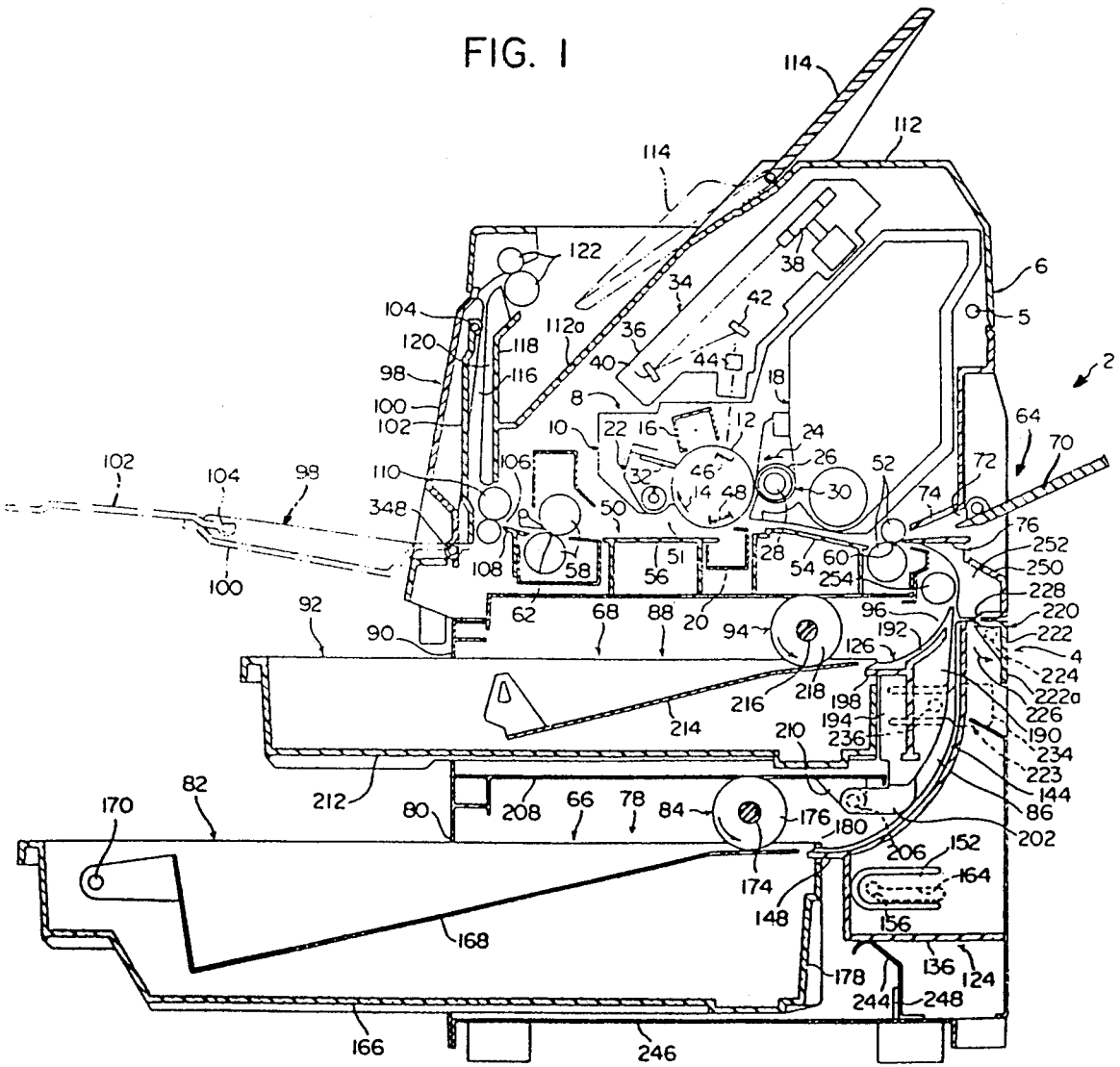
FIG. 1 is a sectional view showing in a simplified manner one embodiment of a laser beam printer which is one example of the image-forming machine in accordance with this invention.

With reference to FIG. 1, the outline of one embodiment of a laser beam printer as one example of the image-forming machine in accordance with this invention will be described.

In FIG. 1, the illustrated laser beam printer includes a nearly rectangular paralellpipedal main body 2 which has a so-called shell-type, i.e. vertically divisible, structure comprised of a lower frame member 4 and an upper frame member 6 mounted on the lower frame member 4 through a shaft member 5 (constituting a central axis extending perpendicularly to the sheet surface in FIG. 1) so that it is free to pivot between an opening position (not shown) and a closing position (the position shown in FIG. 1).

A process unit shown by reference numeral 8 is disposed in the upper frame member 6 of the main body 2. The illustrated process unit 8 is provided with a unit frame 10 detachably mounted on the upper frame member 6, and a rotating drum 12 is rotatably mounted on the unit frame 10. An electrostatographic material is disposed on the peripheral surface of the rotating drum 12. Around the rotating drum 12 which is to be rotated in the direction shown by an arrow 14 are disposed a charging corona discharger 16, a developing device 18, a transfer corona discharger 20 and a cleaning device 22. The developing device 18 is provided with a magnetic brush mechanism 30 comprised of a hollow sleeve 26 to be rotated in the direction shown by an arrow 24 and a stationary permanent magnet 28 disposed within the hollow sleeve 26. The cleaning device 22 includes a cleaning blade 32 adapted to act on the peripheral surface of the rotating drum 12. In the illustrated embodiment, the charging corona discharger 16, the developing device 18 and the cleaning device 22 are mounted on the unit frame 10, and the transfer corona discharger 20, on the lower frame member 4.

An optical unit shown by numeral 34 is disposed in the upper space of the upper frame member 6, i.e. the space above the process unit 8. The optical unit 34 includes a box-like unit housing 36. Within the unit housing 36 are disposed a laser light source (not shown), a rotating polygon mirror 38, a first reflecting mirror 40, a second reflecting mirror 42 and a lens 44. The laser light source (not shown) irradiates laser light based on an image information outputted from a computer, for example, onto the rotating polygon mirror 38. The laser light reflected from the rotating polygon mirror 38 is reflected by the first reflecting mirror 40 and the second reflecting mirror 42, passes through the lens 44 and is projected onto the surface of the rotating drum 12 in a projecting zone 46, as shown by a one-dot chain line in FIG. 1.

In the lower portion of the main body 2, namely in the lower frame member 4, is disposed a conveying means 50 for conveying a sheet material which may be plain paper through a transfer zone 48 existing between the rotating drum 12 and the transfer corona discharger 20. The illustrated conveying means 50 is provided with a conveying roller pair 52, a guide member 54, a guide member 56 and a fixing roller pair 58, and defines a conveying passage 51 extrending nearly in a straight line from the nipping site 60 of the conveying roller pair 52 to the nipping site 62 of the fixing roller pair 58. In the illustrated embodiment, a hand-insertion feed means 64 is provided at the right end of the conveying passage 51, and below the conveying means 50, namely in the lower portion of the lower frame member 4, a first feed means 66 and a second feed means 68 are disposed. The hand-insertion feed means 64 is provided with a table 70 which is free to turn between a feed position shown in FIG. 1 and a storage position turning upwardly by about 90 degrees from the feed position. By utilizing the hand-insertion feed means 64, the table 70 is held at the feed position. When a sheet material is positioned on the table 70 and inserted into an opening 72 formed in the right surface of the main body 2, the sheet material passes between an upper guiding portion 74 and a lower guiding portion 76 and is conducted to the conveying roller pair 52. The first feed means 66 is comprised of a receiving portion 78 defined by the bottom portion of the main body 2, i.e. the bottom portion of the lower frame member 4, a cassette 82 detachably loaded into the receiving section 78 through an opening 80 formed in the left surface of the main body 2, and feed means 84 disposed above the receiving portion 78. Sheet materials are loaded into the cassette 82. When the feed means 84 is rotated in the direction shown by an arrow the uppermost sheet material in the cassette 82 is delivered from the cassette 82 and fed into the conveying passage through a first feed passage 86. The second supply means 68 positioned above the first supply means 66 is comprised of a receiving portion 88 defined in the upper portion of the lower frame member 4, a cassette 92 loaded detachably into the receiving portion 88 through an opening 90 formed in the left surface of the main body 2, and feed means 94 disposed above the receiving portion 88, and sheet materials are loaded into the cassette 92. When the feed means 94 is rotated in the direction of arrow, the uppermost sheet material is delivered from the cassette 92, and fed to the conveying passage through the second feed passage 96.

A receiving plate 98 constituting a first receiving means is disposed in the left end portion in FIG. 1 of the main body 2. The illustrated receiving plate 98 is comprised of a first plate 100 having a slightly concave upper surface (the upper surface in the state shown by a two-dot chain line in FIG. 1) and a second plate 102 extending nearly in a straight line. The first plate 100 and the second plate 102 are free to pivot via a pin 104 between an operative position (the position shown by a two-dot chain line in FIG. 1; the pivoting movement of the second plate 102 beyond the operative position is hampered by the contacting of the base portion of the second plate 102 with the end of the plate 100) and a storage position (the position shown by a solid line in FIG. 1; the pivotting movement of the second plate 102 beyond the operative position is hampered by the contacting of the end portion of the second plate 102 with the base portion of the first plate 100). The receiving plate 98 is free to pivot between a receiving position shown by the two-dot chain line in FIG. 1 and a storage position shown by the solid line in FIG. 1 around a protrusion 348 as a center. When the receiving plate 98 is at the receiving position, the second plate 102 is held at the operating position (it may be at the storage position if the sheet material is small), and the receiving plate 98 extends nearly horizontally from the main body 2 of the laser beam printer. On the other hand, when the receiving plate 98 is at the receiving position (at this time, the second plate 102 is also held at the storage position and received in the concave portion of the upper surface of the first plate 100), the receiving plate 98 extends nearly perpendicularly upwardly A first discharge passage 106 is provided between the receiving plate 98 and the conveying passage 51. The illustrated first discharge passage 106 is defined by a guide member 108 and a first discharge roller pair 110. When the receiving plate 98 is at the receiving position, the sheet material conveyed through the conveying passage 51 and the first discharge passage 106 is discharged directly onto the receiving plate 98. In the illustrated embodiment, there is also provided a second receiving means in the upper end of the main body 2. The second receiving means is defined by an inclined upper surface 112*a* in the upper wall 112 of the main body 2. In the upper end portion of the inclined upper surface 112*a* is mounted an auxiliary receiving member 114 which is free to pivot between a receiving position extending following the inclined upper surface 112*a* and a storage position above the inclined upper surface 112*a*. A second discharge passage 116 is provided between the second receiving member and the first discharge passage 106. The second discharge passage 116 is defined by the receiving plate 98 at the storage position (particularly, the right surface in FIG. 1 of the second plate 102 in the storage state), a plurality of guide ribs 120 (one of which is shown in FIG. 1) provided on the inner surface of the wall 118 and a second discharge roller pair 122. When the receiving plate 98 is at the storage position, the sheet material conveyed through the conveying passage and the first discharge passage 106 is further conducted upwardly, passes through the second discharge passage 116, and is discharged onto the inclined upper surface 112*a* of the upper wall 112 by the action of the second discharge roller pair 122.

The operation of the laser beam printer described above will be described below in a general manner. While the rotating drum 12 is rotated in the direction of arrow 14, the charging corona discharger 16 charges the electrostatographic material of the rotating drum 12 to a specific polarity. Then, in the projecting zone 46, laser light from the laser light source (not shown) in the optical unit 34 is projected onto the electrostatographic material. As a result, a latent electrostatic image corresponding to the image information is formed on the surface of the electrostatographic material. Thereafter, a magnetic brush produced by the magnetic brush mechanism 30 of the developing device 18 acts on the electrostatographic material. Consequently, by the image-forming means including the developing device 18, a toner image corresponding to the image information is formed on the surface of the electrostatographic material. Then, a sheet material supplied to the conveying passage 51 from the feed means (the hand insertion feed means 64, the first feed means 66 or the second feed means 68) is brought into intimate contact with the electrostatographic material of the rotating drum 12 in the transfer zone 48, and by the action of the transfer corona discharge 20, the toner image on the electrostatographic material is transferred to the sheet material. The sheet material to which the toner image has thus been transferred is peeled from the rotating drum 12 and conveyed to the fixing roller pair 58. By the action of the fixing roller pair 58, the toner image is fixed to the surface of the sheet material. The sheet material bearing the toner image is further fed into the first discharge passage 106, and when the receiving plate 98 is at the receiving position, directly discharged onto the receiving plate 98 from the first discharge roller pair 110. It will be easily understood from FIG. 1 that when the sheet material is so discharged, the image-bearing surface of the sheet faces upwardly upon discharge. On the other hand, when the receiving plate 98 is at the storage position, the sheet material is introduced into the second discharge passage 116 from the first discharge passage 106, passes through the second discharge passage 116, and is discharged from the second discharge roller pair 122 onto the inclined upper surface 112*a* of the upper wall 112. It will be easily seen from FIG. 1 that when the sheet material is so discharged, the image-bearing surface of the sheet material faces downwardly upon discharge. At this time, therefore, it is not necessary to perform page rearrangement of the discharged image-bearing sheet materials. In the meantime, the rotating drum 12 continues to rotate, and the toner remaining on the surface of the electrostatographic material is removed by the action of the cleaning blade 32.

FIRST FEED PASSAGE, SECOND FEED PASSAGE AND RELATED ELEMENTS

Now, a detailed description will be given on the first feed passage 66 for conducting the sheet material delivered from the first feed means 66 to the conveying passage, the second feed passage 96 for conducting the sheet material delivered from the second feed means 68 to the conveying passage, and elements related to them.

Figure 2:
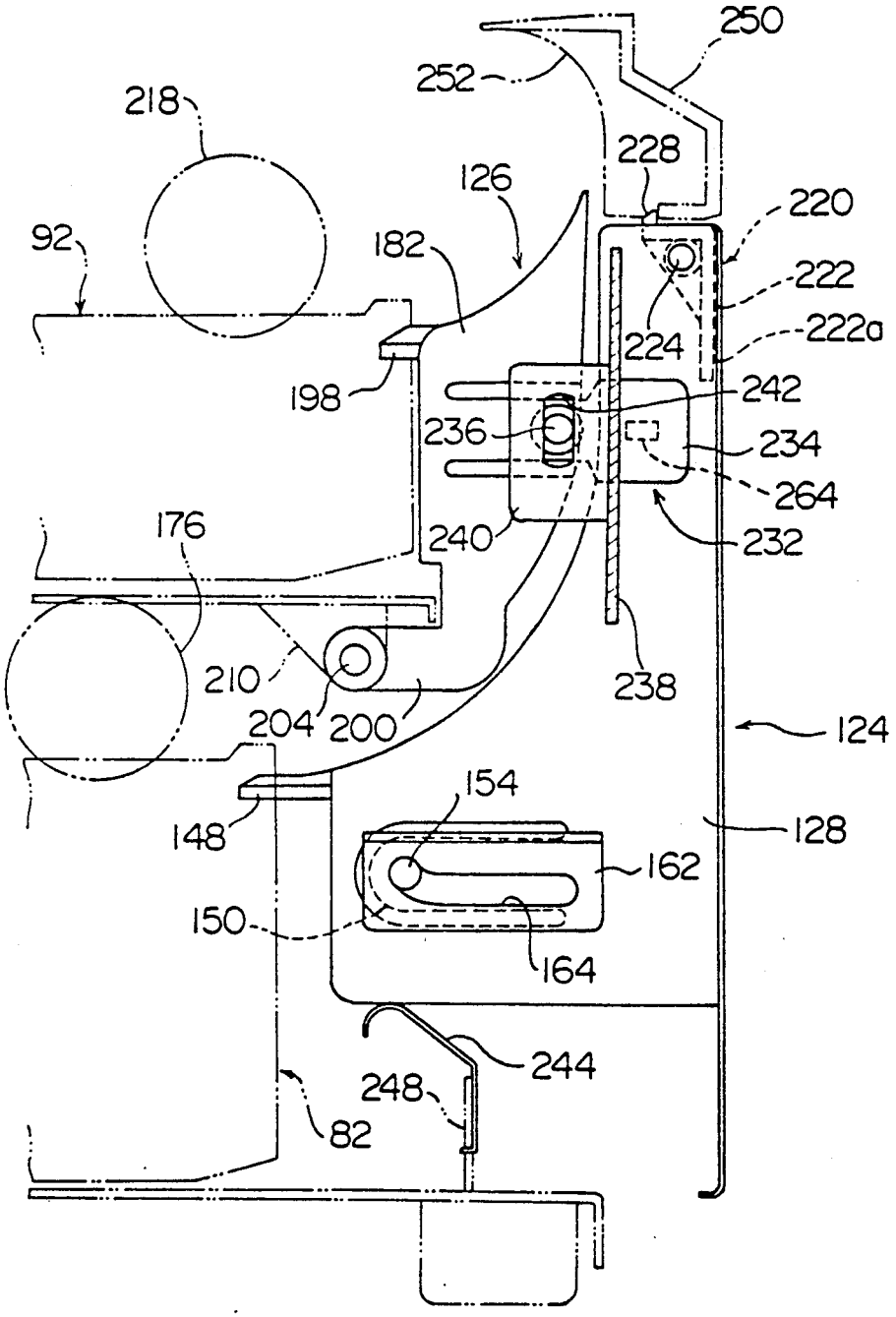
FIG. 2 is a partial sectional view showing a first opening-closing member and a second opening-closing member and elements relating to them in the laser beam printer of FIG. 1.

With reference to FIG. 2 as well as FIG. 1, a greater portion of the first feed passage 86 is defined by a first opening-closing member 124 and a second opening-closing member 126, and a greater portion of the second feed passage 96 is defined by the second opening-closing member 126. The downstream portion of the first feed passage 86 and the downstream portion of the second feed passage 96 are associated, and the associated portion of the two passages is connected to the upstream end of the conveying passage 51.

Figure 3:
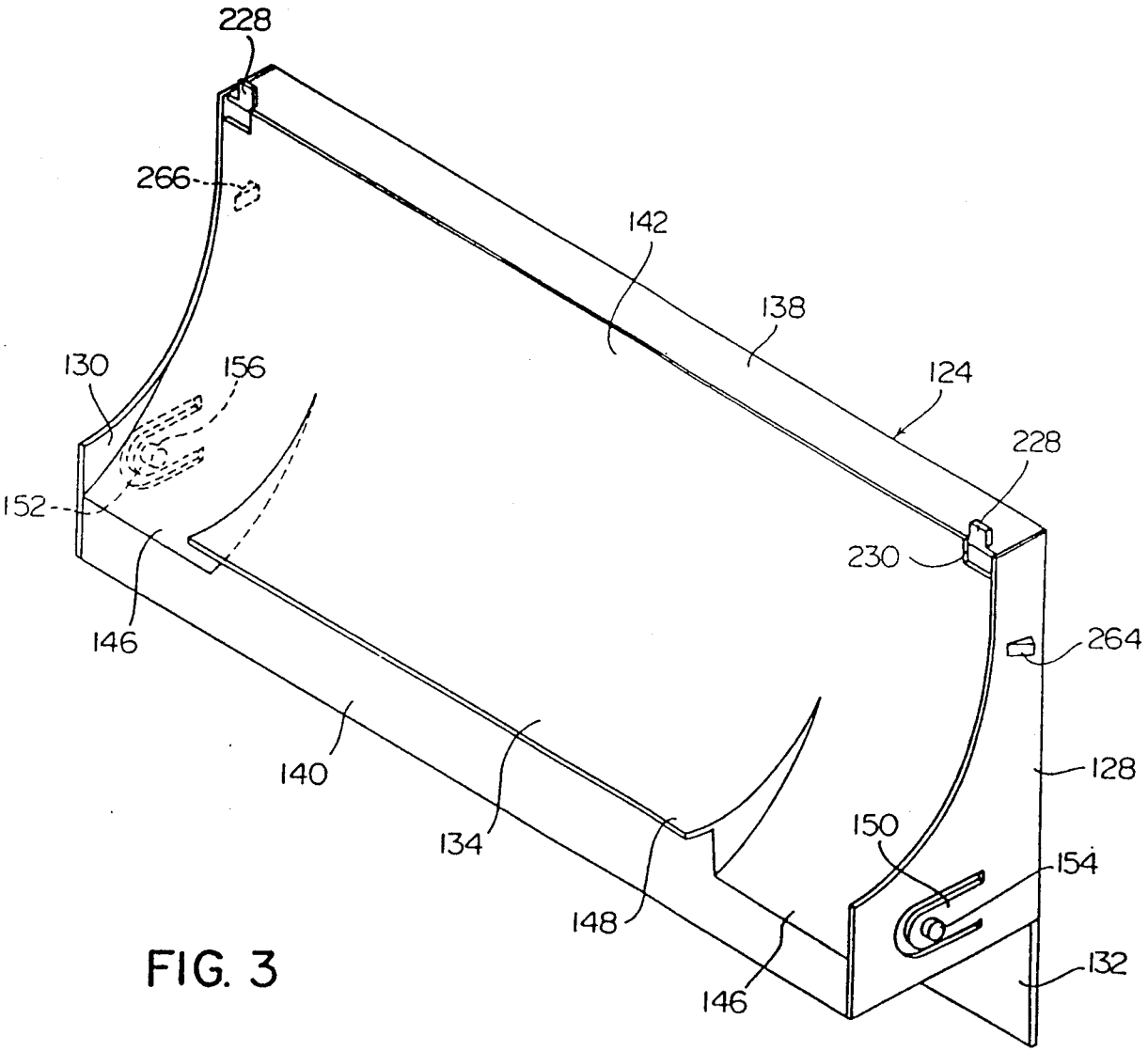
FIG. 3 is a perspective view showing the first opening-closing member of FIG. 2.

With reference to FIG. 3, the illustrated first opening-closing member 124 has a pair of end walls 128 and 130 spaced from each other a predetermined distance, and between these end walls 128 and 130 are provided an outside wall 132, an inside wall 134, a bottom wall 136 and an upper wall 138 (see FIG. 1 also). In the illustrated embodiment, the inside wall 134 has a substantially flat lower portion 140 and an upper portion 142 extending upwardly in an arcuate curved shape, and as can be seen from FIGS. 1 and 2, the inside surface of the upper portion 142 of the inside wall 134 defines one side of the first feed passage 86, i.e. its right side in FIG. 1. As shown clearly in FIGS. 1 and 5, a plurality of guide ribs 144 in spaced-apart relationship in the widthwise direction (the direction perpendicular to the sheet surface in FIG. 1, the vertical direction in FIG. 5) are provided integrally on the inside surface (the surface acting as a guiding surface) of the upper portion 142 of the inside wall 134 (in FIG. 3, the guide ribs 144 are omitted). Contact-preventing depressed portions 146 are defined in both end portions in the widthwise direction of the upper portion 142 of the inside wall 134 In the illustrated embodiment, the central part in the widthwise direction of the upper portion 142 of the inside wall 134 extends downwardly with a relatively large curving from the nearly central part in the vertical direction. On the other hand, both end portions in the widthwise direction of the upper portion 142 of the inside wall 134 extend downwardly with a relatively small curving from its nearly central part in the vertical direction. By the differences in curvature between these curved surfaces, the contact-preventing depressed portions 146 are provided in both ends of the upper portion 142. In the illustrated embodiment, an introduction protrusion 148 protruding into the receiving portion 78 of the first supply means 66 are provided integrally, and nearly horizontally in FIGS. 1 and 2, in the upstream end of the central part, in the widthwise direction, of the upper portion 142. The introduction protrusion 148 is provided over substantially the entire width of the part between the contact-preventing depressed portions 146 in the upper portion 142 of the inside wall 134, and the guide ribs 144 provided on the upper portion 142 of the inside wall 134 extend to the introduction protrusion 148.

Supporting portions 150 and 152 are formed integrally in the end walls 128 and 130 of the first opening-closing member 124 by removing them locally in a nearly U shape, and outwardly projecting pins 154 and 156 are provided at the end parts of the supporting portions 150 and 152. On the other hand, the lower frame member 4 has a pair of vertical base plates 158 and 160 (FIG. 5) which are disposed in spaced-apart relationship perpendicularly to the sheet surface in FIG. 1 and vertically in FIG. 5. Supporting plate pieces 162 are provided in the inside surfaces of the vertical base plates 158 and 160 (FIG. 2 shows only one supporting plate 162 disposed in the inside surface of the base plate 158), and an elongate hole 164 extending to the right nearly horizontally in FIGS. 1 and 2 is formed in each supporting plate piece 162 (FIG. 2 shows one hole 164 formed in one supporting plate piece 162 and FIG. 1 shows the other hole 164 in the supporting plate piece 162 not shown in the drawings). One end portion (the left inside end portion in FIGS. 1 and 2) extends while curving slightly upwardly. The pins 154 and 156 provided in the first opening-closing member 124 are detachably received in the pair of elongate holes 164. If desired, it is possible to provide pins in the vertical base plates 158 and 160 and elongate holes in the end walls 128 and 130 of the first opening-closing member 124. The first opening-closing member 124 may be formed of a synthetic resin, and by pressing the base parts of the supporting portions 150 and 152, it can be elastically deformed inwardly. This elastic deformation permits detachment of the pair of pins 154 and 156 from the corresponding holes 164. As will be described in detail later on, the first opening-closing member 124 is free to move between an operating position at which the pins 154 and 156 are positioned respectively at the end portions of the holes 164 (the position shown in FIGS. 1 and 2 and by a two-dot chain line 124 in FIG. 7) and a removed position at which the pins 154 and 156 are positioned in the other end portions of the holes 164 (the position in FIG. 7 by a solid line and in FIG. 8) along these holes 164, and also free to pivot between a closing position at which it defines one side of the first feed passage 86 (the position shown in FIGS. 1 and 2 and by the two-dot chain line 124 in FIG. 7) and an opening position at which it permits opening of the first feed passage 86 (the position shown in FIG. 7 by a solid line and in FIG. 8).

The contact-preventing depressed portion 146 and the introduction protrusion 148 in the first opening-closing member 124 and the first feed means 66 are further constructed as shown below in the illustrated embodiment.

In the first feed means 66, the cassette 82 is equipped with a box-like cassette body 166 having an open top, which is adapted to be mounted detachably between the pair of vertical base plates 158 and 160 of the lower frame member 4 through the opening 80. A carrying plate 168 is disposed within the cassette body 166, and a biasing spring (not shown) is interposed between the carrying plate 168 and the bottom wall of the cassette body 166. The rear end portion of the carrying plate 168 is mounted on the cassette body via a pin 170 so that the plate 168 is free to pivot. A stack of sheet materials which may be plain paper are placed on the carrying plate 168. Claw members 172 (FIG. 5) for preventing overlapping feed of the sheet materials are disposed at both corners of the front end portion of the cassette body 166. The pair of claw members 172 can slightly move up and down and act on the two corners of the leading end of the sheet materials received in the cassette body. The feed means 84 is provided with a shaft member 174 mounted rotatably between and across the pair of vertical base plates of the lower frame member 4. A pair of feed rollers 176 are mounted on the shaft member 174 in an axially spaced-apart relationship.

Figure 5:
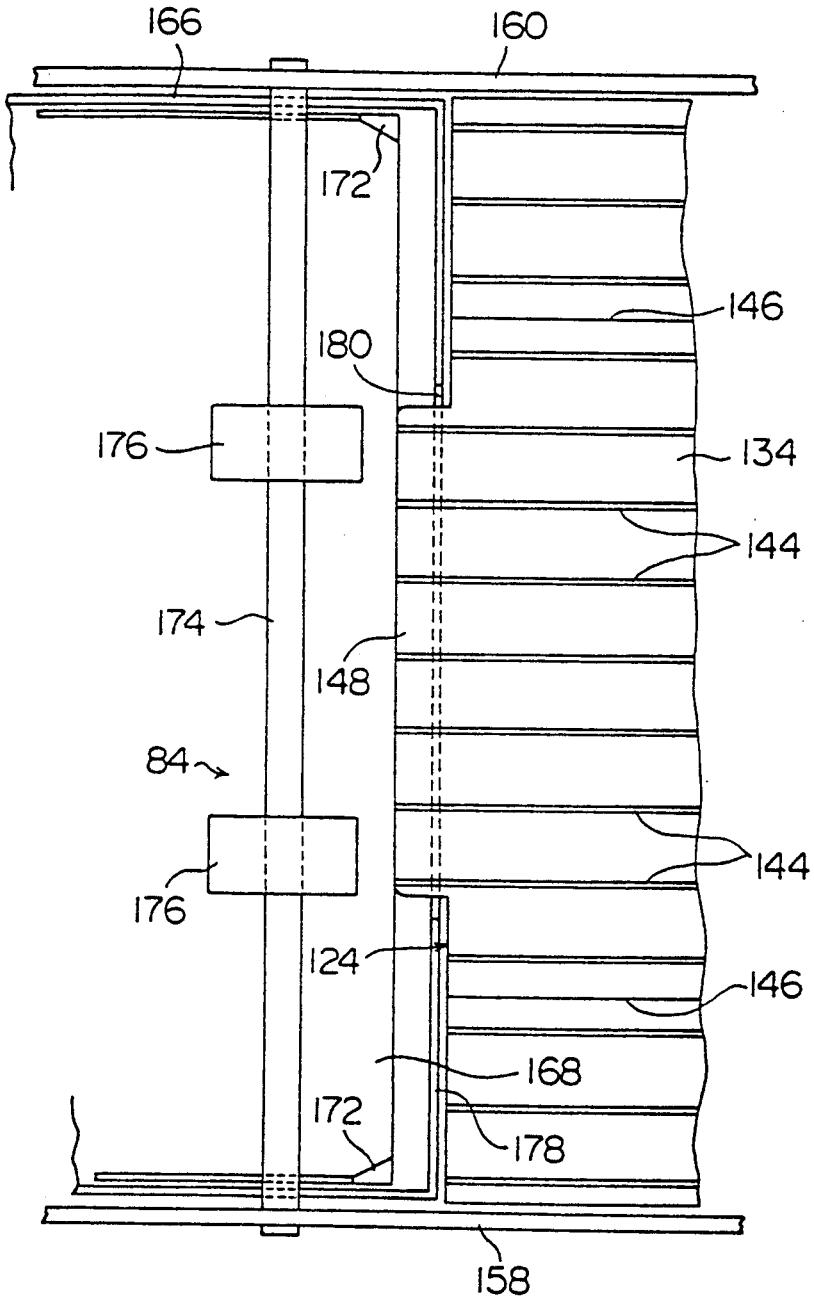
FIG. 5 is a top plan view showing part of a first feed means and its vicinity in the laser beam printer of FIG. 1.
Figure 6:
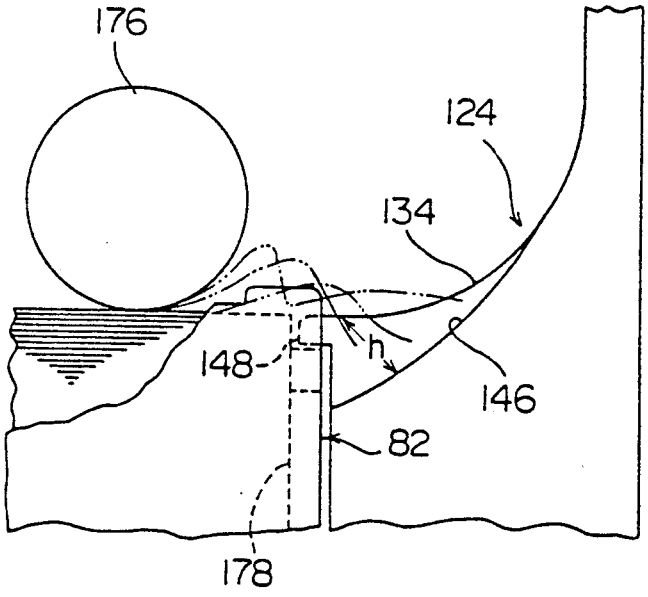
FIG. 6 is a view for illustrating the state of a sheet material delivered from a first feed means.

The first feed means 66 and the contact-preventing depressed portion 146 are arranged in the positional relationship shown in FIG. 5. Specifically, the contact-preventing depressed portion 146 is disposed opposite to the claw member 172 and its vicinity in the cassette 82. Generally, as shown in FIG. 6, when a sheet material whose leading end is arrested at its corners by the claw members 172 is to be delivered, that part of the sheet material which exists between the feed roller 176 and the claw members 172 bends upwardly, leaves the claw members 172 and jumps forwardly (shown by the two-dot chain line in FIG. 6). The sheet material then continues to advance by the action of the feed roller 176. Accordingly, if the contact-preventing depressed portion 146 is not provided, the corners of the leading end of the sheet material (particularly, that part which exists between the feed roller 176 and the claw members 172) will contact the inside wall 134 of the first opening-closing member 124 and is likely to fold downwardly. The provision of the contact-preventing depressed portions 146 in both widthwise end portions of the inside wall 134 serves to accurately prevent the corner portions of the leading end of the sheet material from contacting the inside wall 134 upon delivery from the cassette 82. The side of the contact-preventing depressed portion 146 is such that the leading end of the sheet material does not contact the inside wall 134. A sufficient effect can be obtained, for example, when the height h in FIG. 6 is about 15 mm. When as in the illustrated embodiment, the feed means 84 is composed of the pair of feed rollers 176, it is preferable to provide one contact-preventing depressed portion 146 opposite to the part between one feed roller 176 and the claw members 172 and the other contact-preventing depressed portion 146 opposite to the part between the other feed roller 176 and the claw members 172.

The first feed means 66 and the introduction protrusion 148 are arranged in the positional relationship shown in FIG. 1, 5 and 6. Specifically, the introduction protrusion 148 is constructed such that its end 148 projects to a point above the front wall 178 of the cassette body 166 loaded in the cassette-receiving section 78, and its protruding end surface defines nearly the same plane with the inside surface of the front wall 178 (in relation to this structure, a cut 180 corresponding to the introduction protrusion 148 is formed in the upper end of the front wall 178 of the cassette body 166). Accordingly, the projecting end surface of the introduction protrusion 148, as can be understood from FIG. 1, restricts the leading ends of the sheet materials received in the cassette body 166 and the inside surface of the front wall 178 of the cassette body 166 In the prior art, the introduction protrusion 148 for conducting the sheet material delivered from the cassette 82 to the first feed passage 86 is not provided, and in this case, a space exists between the front wall 178 of the cassette body 166 loaded in the cassette-receiving section 78 and the inside wall 134 of the first opening-closing member 124. Hence, when the sheet material delivered from the cassette body 166 is fed to the upwardly curved feed passage and its trailing end passes through the above-mentioned space, the stiffness of the sheet material itself causes its trailing end to touch the upstream end of the inside wall 134, and consequently, produce noises. If, on the other hand, the introduction protrusion 148 is provided as described above, there is substantially no space between the front wall 178 of the cassette body 166 and the inside wall 134 of the opening-closing member 124 at a part where the introduction protrusion 148 exists The sheet material delivered from the cassette body 166 is therefore guided by the upper surface of the introduction protrusion 148 and conducted to the first feed passage 86, and its trailing end is accurately prevented from contacting the upstream end of the inside wall 134. To conduct the sheet material smoothly to the first feed passage 86, it is preferable to design the introduction protrusion 148 such that the uppermost sheet material in the stack of sheet materials in the cassette body 166 exists on nearly the same level as the upper surface of the introduction protrusion 148. This construction serves to prevent the occurrence of noises effectively.

When as in the illustrated embodiment, the feed means 84 consists of the pair of feed rollers 176, that part of the sheet material which exists between the feed rollers 176 is fed stably by the feed rollers 176. It is preferable therefore to provide the introduction protrusion 148 in correspondence to that part of the sheet material which is stably delivered, namely that part which exists between the pair of feed rollers 176.

Figure 4:
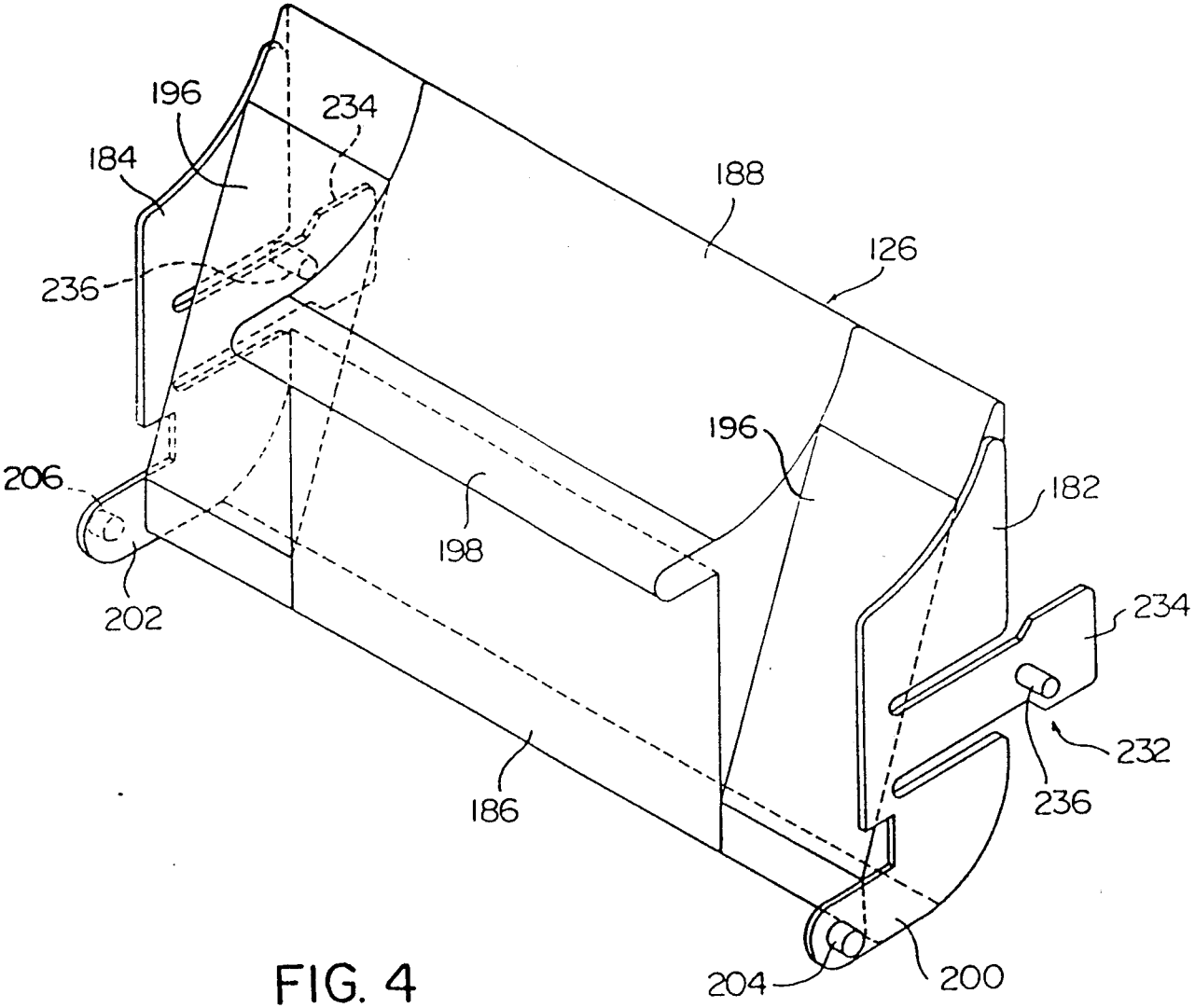
FIG. 4 is a perspective view showing the second opening-closing member of FIG. 2.

Now, with reference to FIGS. 1, 2 and 4, the second opening-closing member 126 will be described in detail. The illustrated second opening-closing member 126 has a pair of spaced end walls 182 and 184 which are slightly larger than the pair of end walls 128 and 130 in the first opening-closing member 124, and a lower wall 186 extending downwardly in a straight line and an upper arcuate wall 188 extending while curving upwardly are disposed between the pair of end walls 182 and 184. As can be understood from FIGS. 1 and 3, in the illustrated embodiment, the outside surfaces (the right surfaces in FIGS. 1 and 2) of the lower wall 186 and the upper arcuate wall 188 define the left side in FIG. 1 of the first feed passage 86, and the inside surface (the left surface in FIGS. 1 and 2) of the upper arcuate wall 188 defines the right side in FIG. 1 of the second feed passage 96. As clearly shown in FIG. 1, in the second opening-closing member 126, a plurality of guide ribs 190 are provided in spaced-apart relationship on the outside surfaces of the lower wall 186 and the upper arcuate wall 188 in the widthwise direction (perpendicularly to the sheet surface in FIGS. 1 and 2), and a plurality of guide ribs 192 are provided at widthwise intervals on the inside surface of the upper arcuate wall 188. Furthermore, a plurality of contacting ribs 194 are provided on the inside surface of the lower wall 186 at widthwise intervals. In FIG. 4, the guide ribs 190 and 192 and the contacting ribs 194 are omitted. In the second opening-closing member 126, a contact-preventing depressed portion 196 is defined in both widthwise end portions of the upper arcuate wall 188, and an introduction protrusion 198 slightly projecting into the cassette receiving section 88 of the second supply means 68 in the widthwise central part of the upper arcuate wall 188 which acts as a guiding surface of the second feed passage 96, as in the first opening-closing member 124. In the illustrated embodiment, the widthwise central part of the upper arcuate wall 188 extends downwardly while curving relatively greatly, and the widthwise end portions of the upper arcuate wall 188 extend inclinedly downwardly in a nearly straight line. By these differences in shape, the contact preventing depressed portions 196 are formed in these end portions. The introduction protrusion 198 is provided over substantially the entire width of a part between the contact-preventing depressed portions 196 in the upper arcuate wall 188, and extends nearly horizontally to the left in FIGS. 1 and 2 towards the cassette receiving section 88. The guide ribs 192 extend to the introduction protrusion 198.

Supporting protrusions 200 and 202 projecting to the left in FIGS. 1 and 2 are integrally provided in the lower end portions of the end walls 182 and 184 of the second opening-closing member 126, and pins 204 and 206 projecting outwardly are provided in the supporting protrusions 200 and 202. On the other hand, a plate 208 defining the under surface of the cassette receiving section 88 is set between the pair of vertical base plates 158 and 160 (FIG. 5) of the lower frame member 4. To the undersurface of the plate 208 are secured a pair of supporting brackets (FIG. 2 shows a front bracket 210 and FIG. 1, a rear bracket 210). The pins 204 and 206 in the second opening-closing member 126 are detachably and pivotally mounted on the pair of supporting brackets 210. The second opening-closing member 126 can also be formed of a synthetic resin. By pressing the base plates of the supporting protrusions 200 and 202, they can be elastically deformed inwardly, and the pins 204 and 206 can be detached from the supporting brackets 210. As will be described in detail later on, the second opening-closing member 126 is free to pivot between a closing position (the position shown in FIGS. 1 and 2) at which its inside surface defines one side of the second feed passage 96 and its outside surface defines the other surface of the first feed passage 86) and an opening position (the position shown in FIG. 8) at which it opens the second feed passage 96.

The second feed means 68 is of substantially the same construction as the first feed means 66. The cassette 92 is provided with a box-like cassette body 212 having an open top, and is detachably loaded through the opening 90 into the cassette receiving section defined by the pair of vertical base plate 158 and 160 and the plate 208. Within the cassette body 212 is disposed a carrying plate 214 which is free to pivot vertically with its rear end portion as a fulcrum. A biasing spring (not shown) is interposed between the carrying plate 214 and a bottom wall of the cassette body 212. The feed means 94 is equipped with a shaft member 216 rotatably mounted between, and across, the vertical base plates 158 and 160. A pair of feed rollers 218 (only one of which is shown in FIGS. 1 and 2) are mounted on the shaft member 216 in axially spaced relationship.

The contact-preventing depressed portions 196 and the introduction protrusion 198 in the second feed means 68 and the second opening-closing member 126 are arranged in substantially the same positional relationship as the contact-preventing depressed portions 146 and the introduction protrusion 148 in the first feed means 86 and the first opening-closing member 124, and they operate in substantially the same manner. Accordingly, a detailed description of the structure and operation of these members 196 and 198 is omitted herein.

In relation to the first opening-closing member 124, first locking means 220 are provided in order to releasably lock the first opening-closing member 124 into the closing position while it is held at the operating position. The first locking means 220 are disposed respectively at the widthwise end portions of the upper end portions of the first opening-closing member 124. Each of the first locking means 220 is provided with an anchoring member 222, and a shaft portion 224 provided in the anchoring member 222 is pivotally mounted on the inside surface of the end wall of the first opening-closing member 124 (on the inside surface of the end wall 128 in the case of one first locking means 220, and on the inside surface of the end wall 130 in the case of the other first locking means 220). One end portion 222*a* of the anchoring member 222 acts as an operating portion, and is operated in the direction shown by an arrow 226 (FIG. 1) when the anchoring member 222 is held in the released state. A claw portion 228 is provided in the other end portion of the anchoring member 222, and can projects upwardly through an opening 230 formed in the upper wall 138 and the inside wall 134 of the first opening-closing member 124. The anchoring member 222 further has provided therein a biasing spring (not shown) for biasing the anchoring member 222 in a direction opposite to the direction of arrow 226. Usually, the anchoring member 222 is held at a locked position (the position shown in FIGS. 1 and 2 and by a two-dot chain line 222 in FIG. 7) when the action of the biasing spring causes the claw portion 228 to contact the opening end of the upper wall 138.

In relation to the second opening-closing member 126, second locking means 232 are provided in order to releasably lock the second opening-closing member 126 into the above position. The second locking means 232 are provided at the widthwise end portions of the second opening-closing member 126, and have operative projecting portions 234 extending to the right in FIGS. 1 and 2 (one operative projecting portion 234 is provided in the end wall 182, and the other operative projecting portion 234, in the end wall 184). An outwardly projecting locking pin 236 is provided in the end portion of each of the operative projecting portions 234. In the illustrated embodiment, recesses are formed in the end walls 182 and 184 so as to enable the operative projecting portions 234 to be elastically deformed inwardly to a relatively large extent. A pair of plate pieces 240 (one of them is shown in FIG. 2) are disposed in the inside surface of a right outside wall 238 (FIG. 2) in the main body 2 of the machine in correspondence to the operative projecting portions 234. Each of the plate pieces 240 has formed therein a hole 242 capable of releasably receiving the pin 236 of the operative projecting portion 234.

A biasing spring 244 which can be formed of, for example, a plate spring is disposed below the first opening-closing member 124. The biasing spring 244 is secured to a fixing piece 248 attached to a bottom wall 246 in the main body 2 of the machine. Its arcuately curving end portion acts on the bottom wall 136 of the first opening-closing 124 to bias the first opening-closing member 124 counterclockwise in FIGS. 1 and 2 about the pins 154 and 156 as a center.

When locked by the first locking means 220 and the second locking means 232, the first opening-closing member 124 and the second opening-closing member 126 are kept in the state shown in FIGS. 1 and 2. Specifically, the anchoring members 222 in the first locking means 220 are held in the locked position, and the claw portions 228 projecting upwardly through the openings 230 engage the lower end portion of a cover member 250. As a result, the first opening-closing member 124 is locked releasably into the closing position while it is at the operative position. In this closed state, the first opening-closing member 124 is biased clockwise by the action of the biasing spring 244, and thus elastically held at the closing position. Furthermore, the pins 236 in the second locking means 232 are detachably received in the holes 242 of the plate pieces 240, and thus, the second opening-closing member 126 is locked into the closing position. In the above-mentioned state, a greater portion of the first feed passage 86 is defined by the inside surface of the first opening-closing member 124 and the outside surface of the second opening-closing member 126, as shown in FIG. 1. A sheet material delivered from the first feed means 66 passes between the first opening-closing member 124 and the second opening-closing member 126 and further through guide ribs 252 formed in the inside surface of the cover member 250 and a feed roller 254, and is fed to the upstream end of the conveying passage. Most of one side of the second feed passage 96 is defined by the inside surface of the second opening-closing member 126, and a sheet material delivered from the second feed means 68 is guided by the second opening-closing member 126, passes between the guide ribs 252 and the feed roller 254, and is fed to the upstream end of the conveying passage 51.

The illustrated embodiment has the following characteristic features in relation to the feeding of the sheet material from the first feed means 66. As can be understood from FIG. 1, the sheet material delivered from the first feed means 66 acts so as to bias the first opening-closing member 124 clockwise in FIG. 1 about the pins 154 and 156 as a center, or in other words, so as to cause the first opening-closing member 124 to be held at the above opening and closing positions. Accordingly, the first opening-closing member 124 accurately conducts the sheet material delivered from the first feed means 66 between the guide ribs 252 and the feed roller 254 without being displaced from the closing position by the sheet material.

Figure 7:
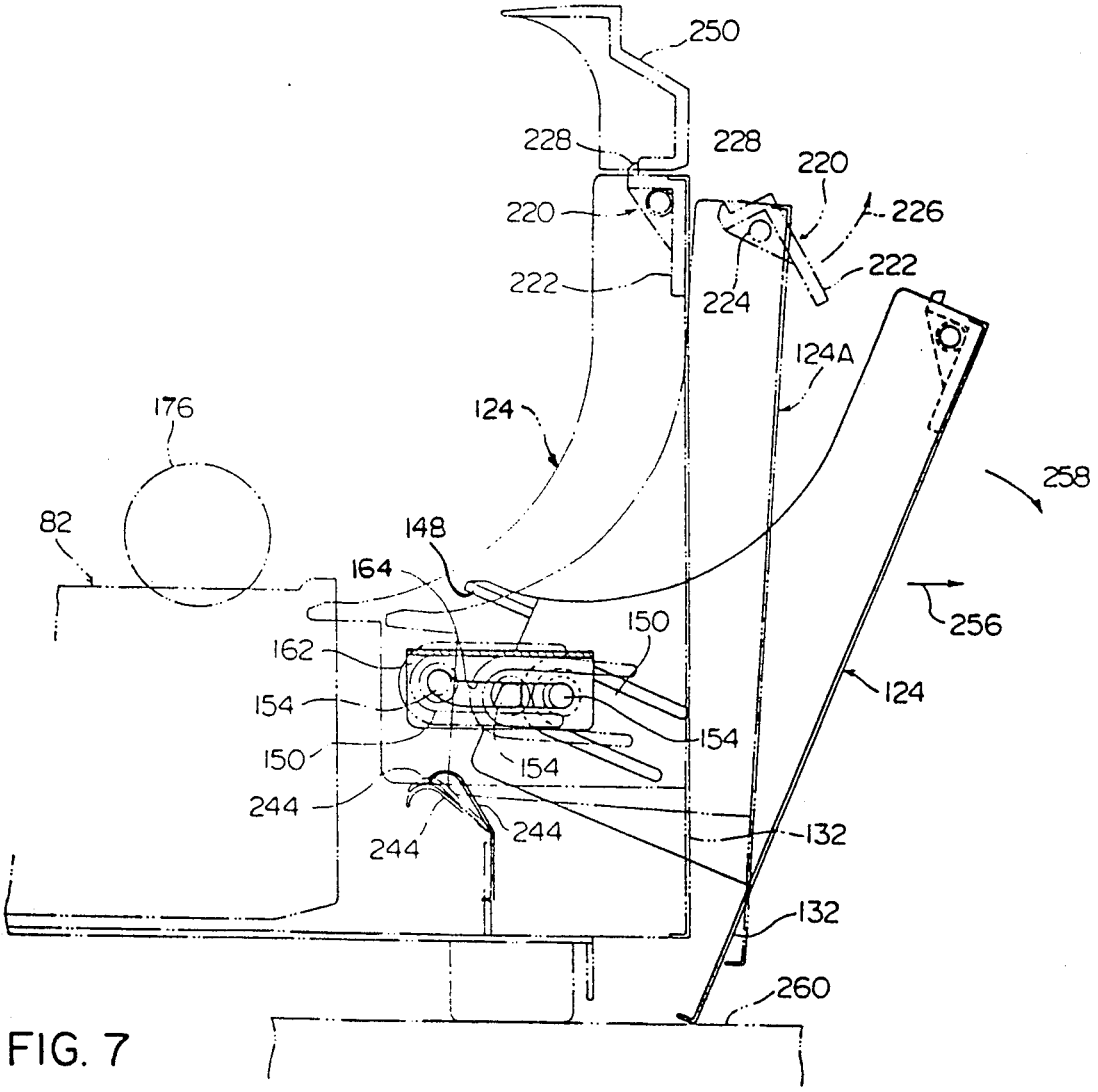
FIG. 7 is a view for illustrating the operation of opening a first feed passage in the laser beam printer shown in FIG. 1.
Figure 8:
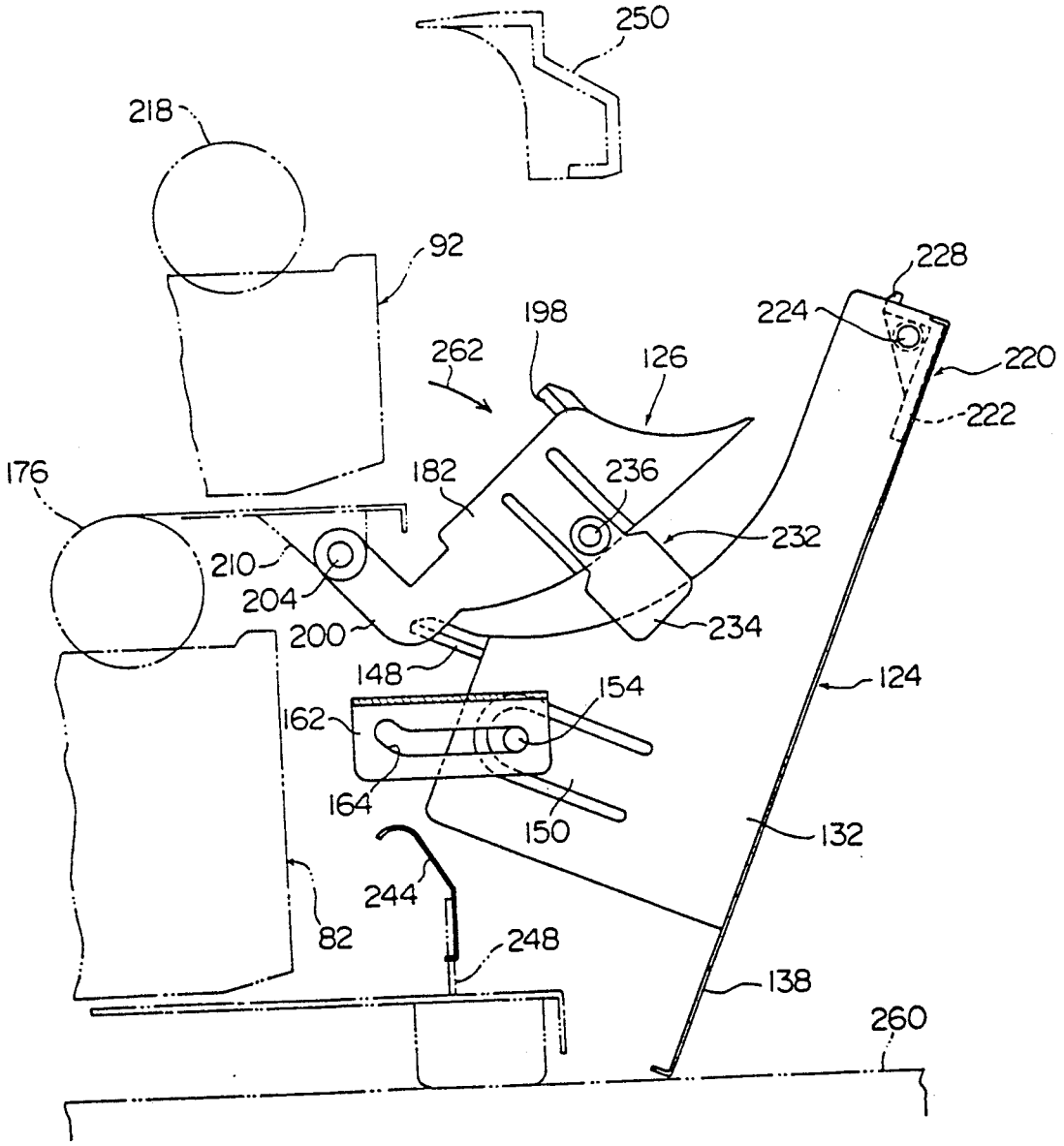
FIG. 8 is a view showing the state in which the first feed passage and a second feed passage in the laser beam printer of FIG. 1 are opened.

To open the first feed passage 86, the anchoring members 222 of the first locking means 220 are pivoted in the direction of arrow 226 through the openings formed in the outside wall 132 of the first opening-closing member 124, as shown in FIG. 7. As a result, the anchoring members 222 are brought to the unlocked position shown in FIG. 7 from the locking position, and the claw portions 228 are substantially received within the first opening-closing member 124 and disengaged from the cover member 250, to permit movement of the first opening-closing member 124. Thereafter, the first opening-closing member 124 is pivoted in the direction shown by an arrow 258 while it is moved in the direction shown by an arrow 256. When the first opening-closing member 124 is moved in the direction of arrow 256 from the above operating position, the pins 154 and 156 move to the right in FIG. 7 within and along the holes 164 of the supporting plate pieces 162, and as the pins 154 and 156 abut with the other ends of the holes 164, the first opening-closing member 124 is held at the operating position past the position shown by the two-dot chain line 124A in FIG. 7. When the first opening-closing member 124 is turned in the direction of arrow 258, it pivots clockwise around the pins 154 and 156 as a center. When the first opening-closing member 124 is held at the opening position shown by the solid line in FIG. 7 while it is at the above removed position, the lower end of its outside wall 132 comes into contact with the upper surface of a table 260 on which the main body 2 of the machine is placed. As a result, the first opening-closing member 124 is held at the opening position at its removed position as shown in FIG. 8 and by the solid line in FIG. 7. It will be appreciated from FIG. 7 that in the closed state, most of the first feed passage 86 is opened, and in the event of paper jamming in the first feed passage 86, the sheet material that has jammed up can be easily removed. In the open state, the pins 154 and 156 can be detached from the holes 162 and 164 by elastically deforming the supporting members 150 and 152 elastically, and the first opening-closing member 124 can be detached from the main body 2 of the machine. In the illustrated embodiment, the first opening-closing member 124 is constructed such that it is free to move between the operating position and the removed position, and when the first feed passage 86 is opened, the first opening-closing member 124 is moved to the removed position and held at the opening position. Accordingly, the first feed passage can be opened to a greater extent than when the first opening-closing member is constructed merely such that it is free to pivot between the opening position and the closing position, and it is much easier to remove the sheet material in the event of paper jamming. Furthermore, since in the illustrated embodiment, the biasing spring biases the first opening-closing member 124 clockwise toward the opening position, as can be seen from FIG. 7, the first opening-closing member 124 can be easily pivoted toward the opening position by the biasing action of the biasing spring 244. Furthermore, since the biasing spring 244 also acts as a supporting guide during the movement of the first opening-closing member 124 between the operating position and the removed position, the first opening-closing member 124 can be smoothly moved in the direction of arrow 256 and in a direction opposite to it.

To open the second feed passage 96 then, the operative protrusions 234 of the second locking means 232 are pressed inwardly through openings formed by positioning the first opening-closing member 124 at the above operating position. As a result, the operating protrusions 234 are elastically deformed inwardly from the locking position and the pins 236 are detached from the holes 242 of the plate pieces 240 to allow the second opening-closing member 126 to be free to pivot. Then, the operative protrusions 234 are pivoted in the direction shown by an arrow 262 (FIG. 8) while it is elastically deformed inwardly. When the opening-closing member 126 is pivoted to the position shown in FIG. 8 from the above closing position, the lower end portion of the lower wall 186 of the second opening-closing member 126 comes into contact with the introduction protrusion 148 of the first opening-closing member 124 at the closing position, whereby the second opening-closing member 126 is held at the opening position shown in FIG. 8. It will be understood from FIG. 8 that in this opening position, most of the second feed passage 96 is opened, and in the event of jamming in the second feed passage 96, the sheet material that has jammed up can be easily removed. In the illustrated embodiment, the first feed passage 86 can be opened to a greater extent than in the prior art, and in relation to it, by pivoting the second opening-closing member 126 to a relatively large extent, it comes into contact with the first opening-closing member 124. Accordingly, the second feed passage 96 can also be opened to a great extent.

To return the second feed passage 96 so opened to the original state, the second opening-closing member 126 is pivoted in a direction opposite to the direction of arrow 262 to the above closing position, and then, the pins 236 in the second locking means 232 are brought into engagement with the holes 242 of the plate pieces 240. In order to return the opened first feed passage 86 to the original state, the first opening-closing member 124 is pivoted in the opposite direction shown by arrow 258 while it is moved in a direction opposite to the direction of arrow 256. As a result, the first opening-closing member 124 is held at the closing position while it is at the operative position. Thereafter, the claw portions 228 of the anchoring members 222 of the first locking means 220 are engaged with the cover member 250.

Figure 9:
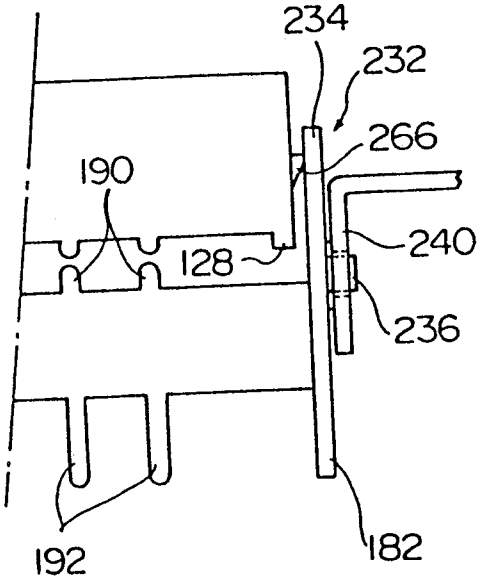
FIG. 9 is a top plan view showing the state in which the first opening-closing member and the second opening-closing member in the laser beam printer shown in FIG. 1 are each held at a closing position.
Figure 9:
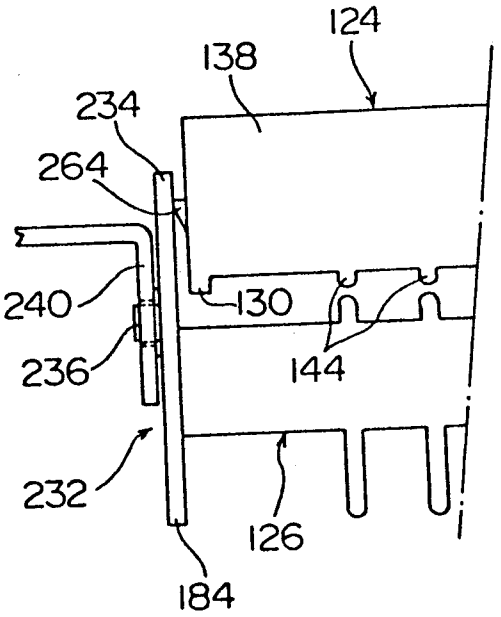

The illustrated embodiment is further constructed as shown below in relation to the second locking means 232. Firstly, it is so constructed that when the second locking means 232 are in the locking condition and then the first opening-closing member 124 is locked into the closing position, it is virtually impossible to cancel the locking of the second locking means 232. With reference to FIG. 9 in conjunction with FIGS. 2 and 3, outwardly projecting nearly triangular operative protrusions 264 and 266 are further provided in the outside surfaces of the end walls 128 and 130 of the first opening-closing member 124 in the illustrated embodiment. These operative protrusions 264 and 266 are disposed in correspondence to, and constructed so as to act on, the operative protrusions 234 in the second locking means 232. More specifically, when the second opening-closing member 126 is held at the closing position and locked by the second locking means 232 and thereafter the first opening-closing member 124 is pivoted to the closing position at the operating position and locked by the first locking means 220, the pair of end walls 128 and 130 of the first opening-closing member 124 are situated inwardly of the pair of end walls 182 and 184 of the second opening-closing member 126 as shown in FIG. 9. In this state, the operative protrusion 264 provided in the end wall 128 acts on the inside surface of the operating protrusion 234 provided in one second locking means 232, and the operating protrusion 266 provided in the other end wall 130 acts on the inside surface of the operating protrusion 234 in the other second locking means 232. In this state, these operative protrusions 264 and 266 accurately prevent the operative protrusions 234 of the second locking means 232 from being elastically deformed inwardly. Consequently, it is virtually impossible to unlock the second locking means 232 and detach the pins 236 from the holes 242 of the plate pieces 240.

Figure 10:
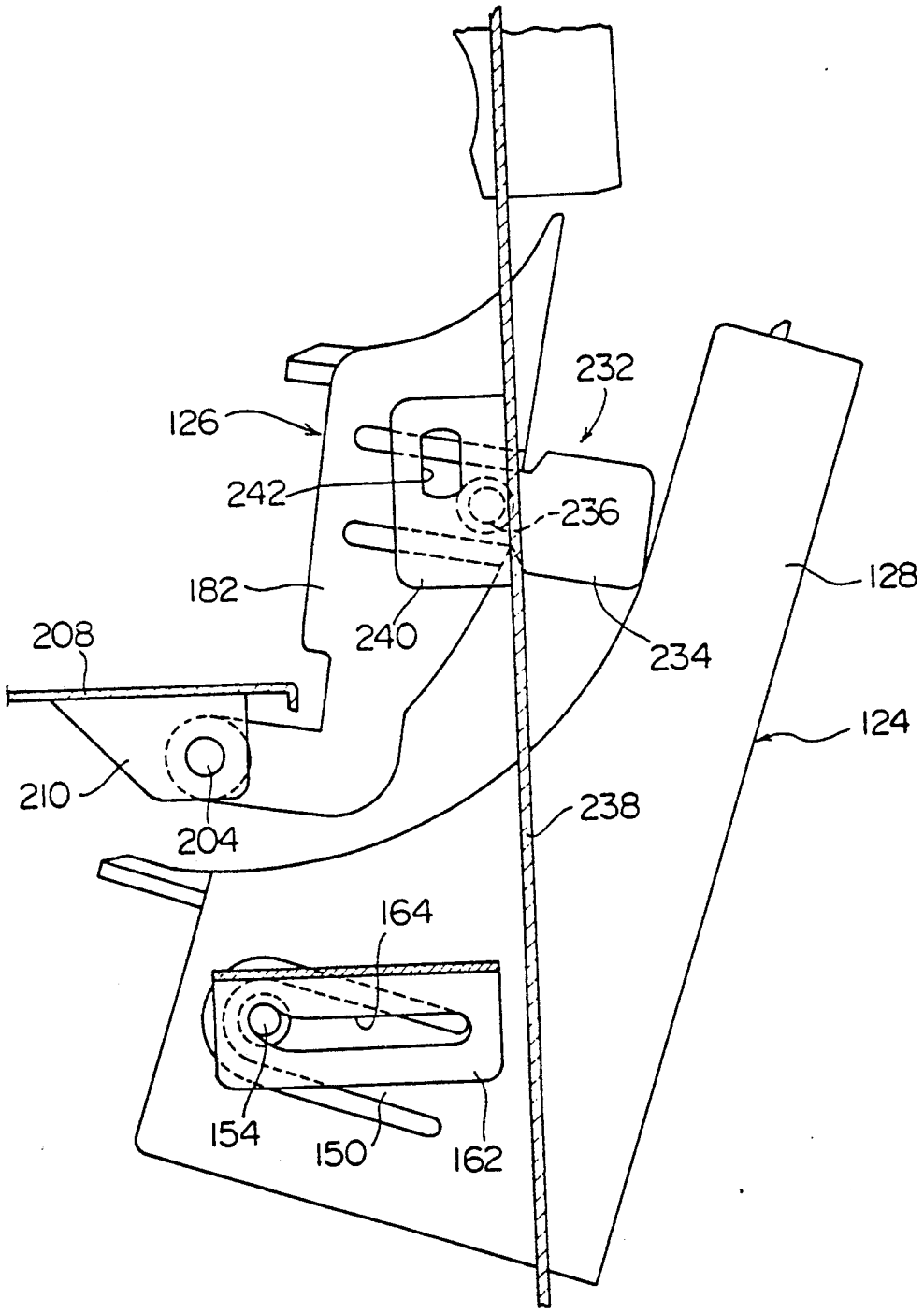
FIG. 10 is a view showing the state in which the first opening-closing member is pivoted toward the closing position when the second opening-closing member is not at the closing position.
Figure 11:
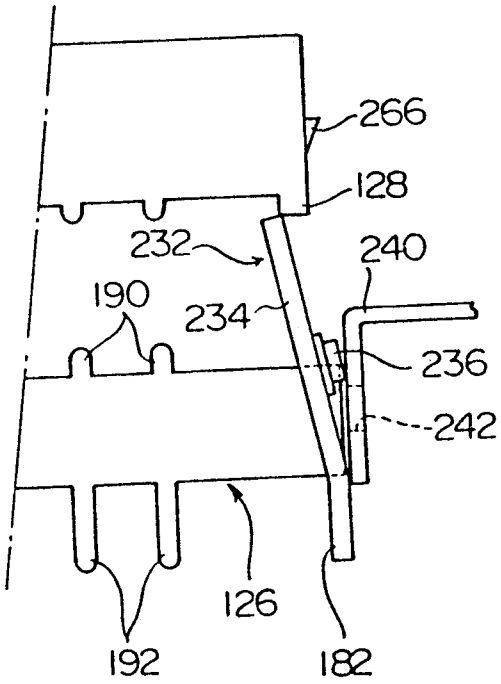
FIG. 11 is a top plan view corresponding to FIG. 10.
Figure 11:
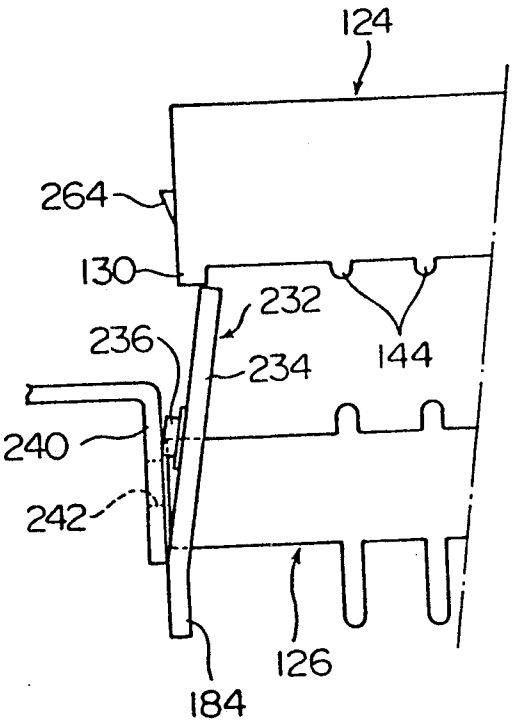

Secondly, the first opening-closing member 124 is designed such that when the second opening-closing member 126 is not locked in the closing position by the second locking means 232, it is virtually impossible to pivot the first opening-closing member 124 to the closing position at the operating position. With reference to FIGS. 10 and 11, when the second opening-closing member 126 is pivoted toward, and near, the above closing position, the pins 236 provided in the operating protrusions 234 of the second locking means 232 is positioned inwardly of the plate piece 240 on the side of the main body 4 of the apparatus. When in this state the inward depressing pressure of the operative protrusions 234 is cancelled, the pins 236 abut with the inside surfaces of the plate pieces 240 without fitting in the holes 242. In this abutting state, the operative protrusions 234 in the second locking means 232 are elastically deformed inwardly, and their free end portions project inwardly inclinedly into the pivoting path of the first opening-closing member 124, as shown in FIG. 11. Accordingly, when in this state the first opening-closing member 124 is pivoted toward the closing position, the opposite end portions (the end walls 128 and 130 in the illustrated embodiment) of the first opening-closing member 124 come into contact with the free end portions of the operative protrusions 234 which are elastically deformed inwardly, and consequently the first opening-closing member 124 cannot be brought to the closing position.

The two structures described above with regard to the second locking means 232 (the structure in which when the second locking means 232 is locked and then the first opening-closing member 124 is locked in the closing position, it is virtually impossible to cancel the locking state of the second locking means 232, and the structure in which when the second opening-closing member 126 is not locked into the closing position by the second locking means 232, the first opening-closing means 124 cannot substantially be brought to the closing position) can also be applied to an apparatus of the type in which the first opening-closing member 124 is simply free to pivot between the opening position and the closing position.

MODIFIED EXAMPLES OF THE METHOD OF MOUNTING THE FIRST OPENING-CLOSING MEMBER

Figure 12:
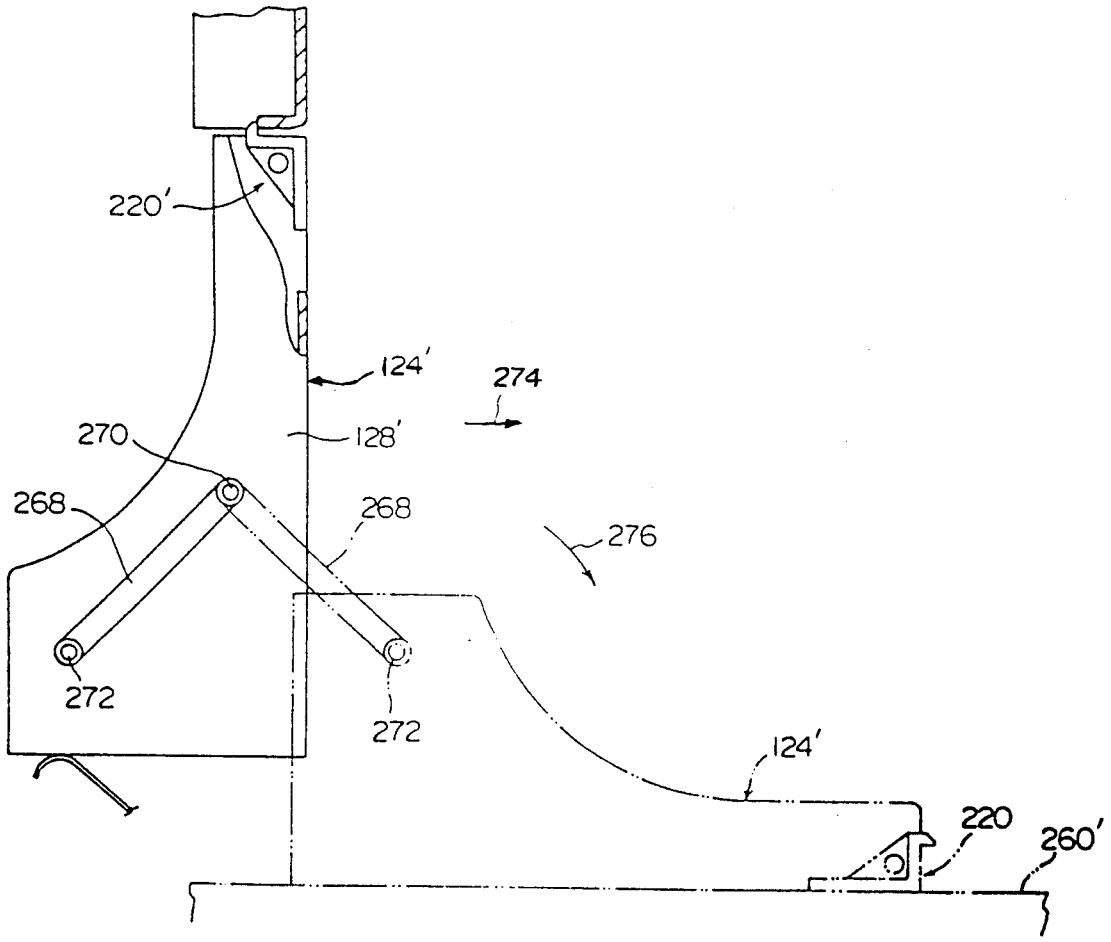
FIG. 12 is a view showing in a simplified manner a first modified embodiment of the manner of mounting the first opening-closing member.
Figure 13:
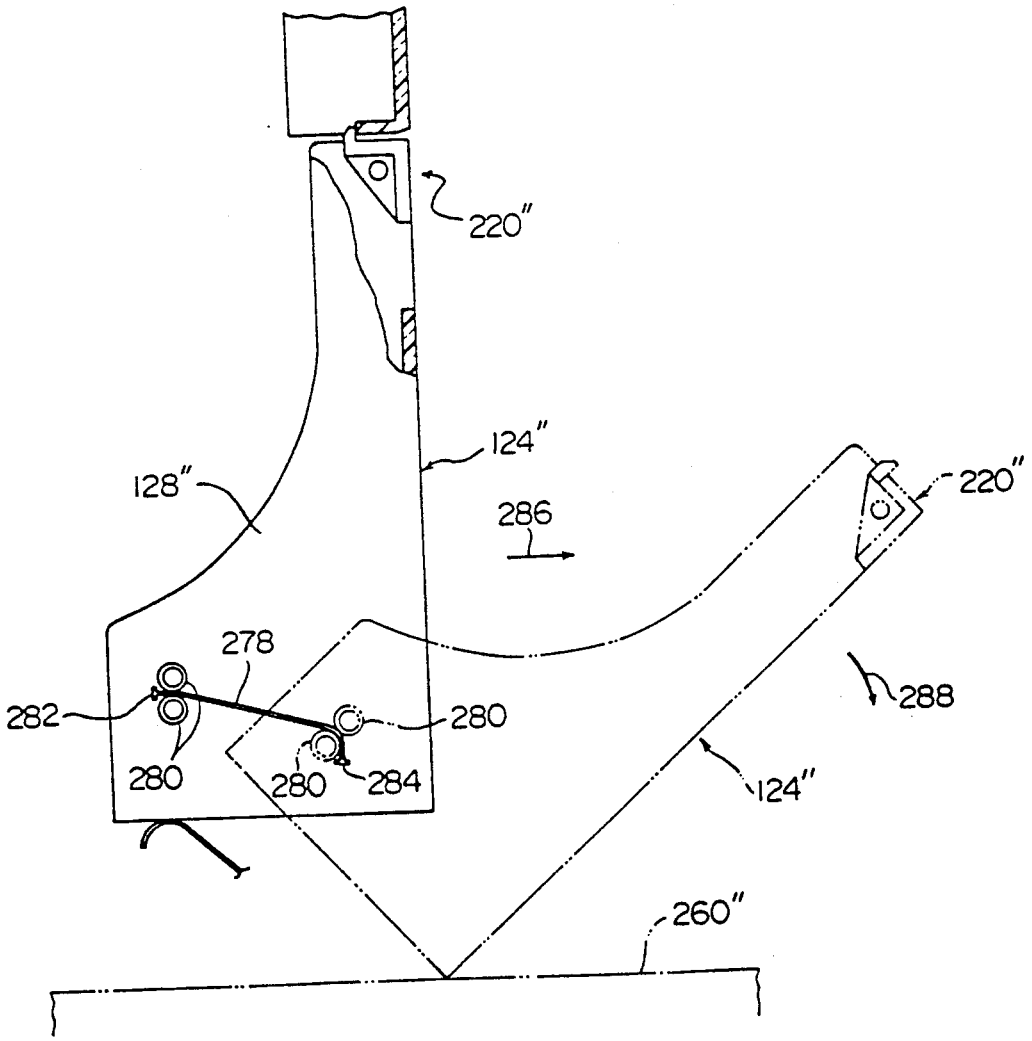
FIG. 13 is a view showing in a simplified manner a second modified example of the manner of mounting the first opening-closing member.

By mounting the first opening-closing member as shown in FIG. 12 or 13, the same operation and result are achieved.

In FIG. 12 showing a first modified example of the method of mounting the first opening-closing member, the first opening-closing member 124' is mounted on the main body of the apparatus via a pair of linking members 268 (only one of them is shown). One linking member 268 is disposed on the side of one end of the first opening-closing member 124', and its one end is linked pivotally to one vertical base plate of the lower frame member via a pin 270. The other end of the linking member 268 is linked pivotally to one end wall 128' of the first opening-closing member 124'. The other linking member 268 is disposed on the side of the other end of the first opening-closing member 124', and its one end is pivotally linked to the other vertical base plate of the lower frame member via a pin while its other end is liked pivotally to the other end wall of the first opening-closing member 124' via a pin.

To open the first feed passage in the first modified example, one releases the first locking means 220' and then moves the first opening-closing member 124' from the operating position shown by a solid line toward the removed position in the direction shown by an arrow 274 and at the same time, pivots it from the closing position shown by a solid line toward the opening position shown by a two-dot chain line in the direction shown by an arrow 276. When the first opening-closing member 124' is pivoted to the opening position at the above removed position, its outside surface comes into contact with the upper surface of the table 260' as shown by a two-dot chain line in FIG. 12 to maintain the first opening-closing member 124' at the opening position. In mounting the first opening-closing member 124' as in the first modified example, too, the first opening-closing member 124' is moved toward the above-mentioned removed position at the time of opening the first feed passage and at the same time, pivoted toward the opening position Accordingly, the first feed passage can be opened to a great extent as in the above-described embodiment FIG. 13 shows a second embodiment of the method of mounting the first opening-closing member. In the second modified embodiment, rail members 278 (one of which is shown) are provided in the inside surfaces of the pair of vertical base plates of the lower frame member. The rail member 278 is slightly inclined downwardly from one end (left side) to the other end (right side), and its other end portion extends downwardly in a nearly vertical direction. A pair of rollers 280 corresponding to one rail member 278 are rotatably mounted on the end wall 128'' of the first opening-closing member 124'', and although not shown, a pair of rollers 280 corresponding to the other rail member 278 are also rotatably mounted on the other end wall of the first opening-closing member 124''. The pair of rollers 280 are disposed vertically and positioned on both sides of the rail member 278 so as to hold them therebetween. Accordingly, the pair of rollers 280 can move along the rail member 278 while rotating. To prevent the pair of rollers 280 from being detached from the rail member 278, it is preferable to provide detachment preventing pieces 282 and 284 in both end portions of the rail member 278.

When the mounting method in the second modified example is used, the first opening-closing member 124" is free to move between an operative position (shown by a solid line) at which the rollers 280 are positioned at one end portion of the rail member 278 and a removed position (shown by a two-dot chain line) at which the rollers 280 are positioned at the other end portion of the rail member 278 and at the same time free to pivot between the closing position shown by the solid line and the opening position shown by the two-dot chain line. At the time of opening the first feed passage, the first opening-closing member 124", after the first locking means 220" is released, is moved toward the removed position in the direction shown by an arrow 286 and pivoted toward the opening position in the direction shown by an arrow 288. When it is pivoted to the opening position while it is at the removed position, the lower end portion of its outside comes into contact with the upper surface of the cable 260" and is consequently held at the opening position As a result, in the second modified embodiment, too, the first feed passage can be opened to a great extent.

DIFFERENT EXAMPLE OF USING THE LASER BEAM PRINTER

Figure 14:
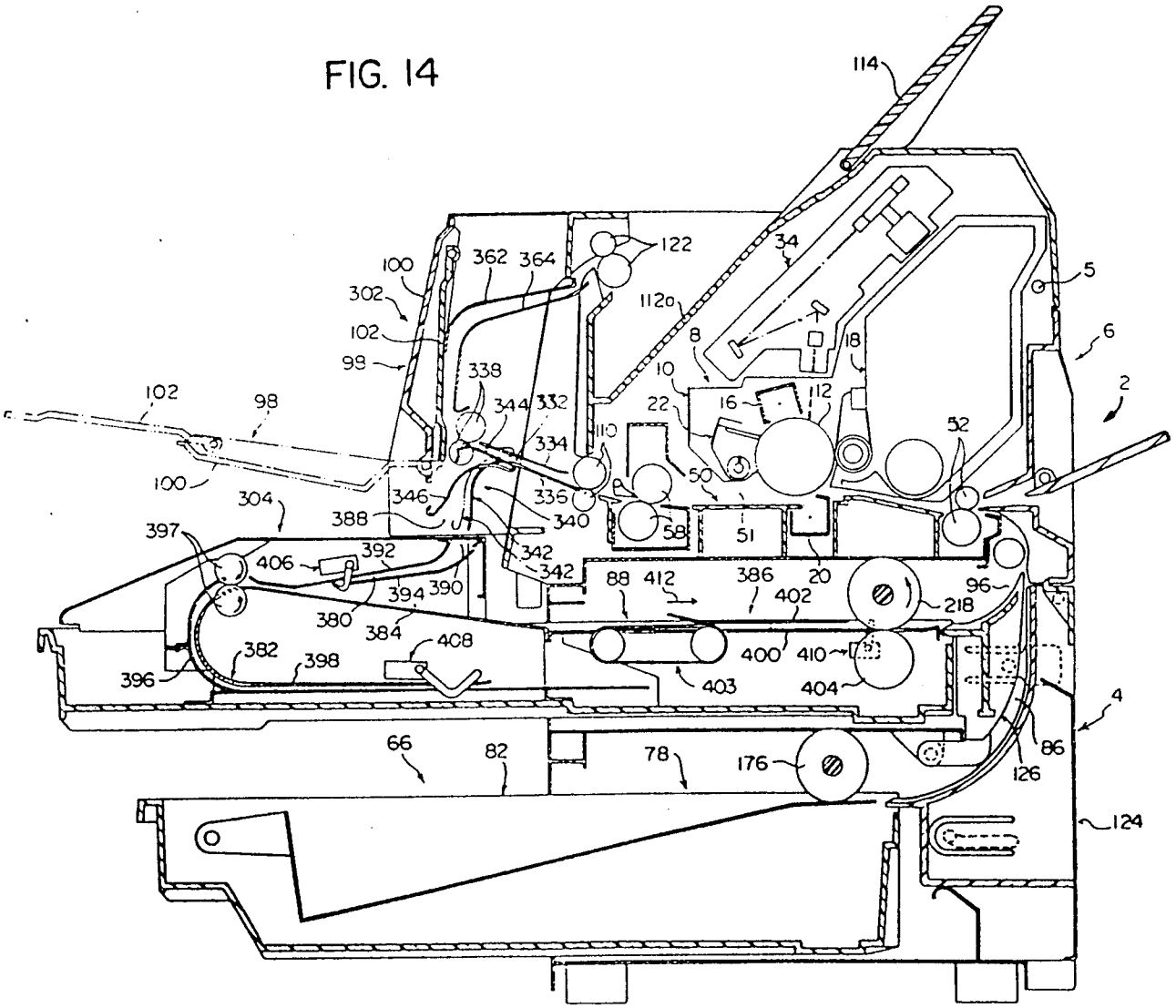
FIG. 14 is a simplified sectional view showing another example of using the laser beam printer of FIG. 1.

The laser beam printer shown in FIG. 1 may be used as shown in FIG. 14 by replacing or adding some parts. For easy understanding, in FIG. 14, the same members as in FIG. 1 are designated by the same reference numerals as in FIG. 1.

With reference to FIGS. 1 and 14 by comparison, in order to change the type shown in FIG. 1 to one shown in FIG. 14, the receiving plate 98 mounted on the upper frame member 6 of the main body 2 of the apparatus is removed, and a discharge unit shown at 302 is attached to the left end in FIG. 1 of the main body 2. Then, the removed receiving plate 98 is secured in position to the discharge unit 302. Thereafter, in place of the cassette 92, an auxiliary unit 304 for both surface image-formation is mounted detachably on the cassette-receiving section 88 in the second feed means 68.

Figure 15:
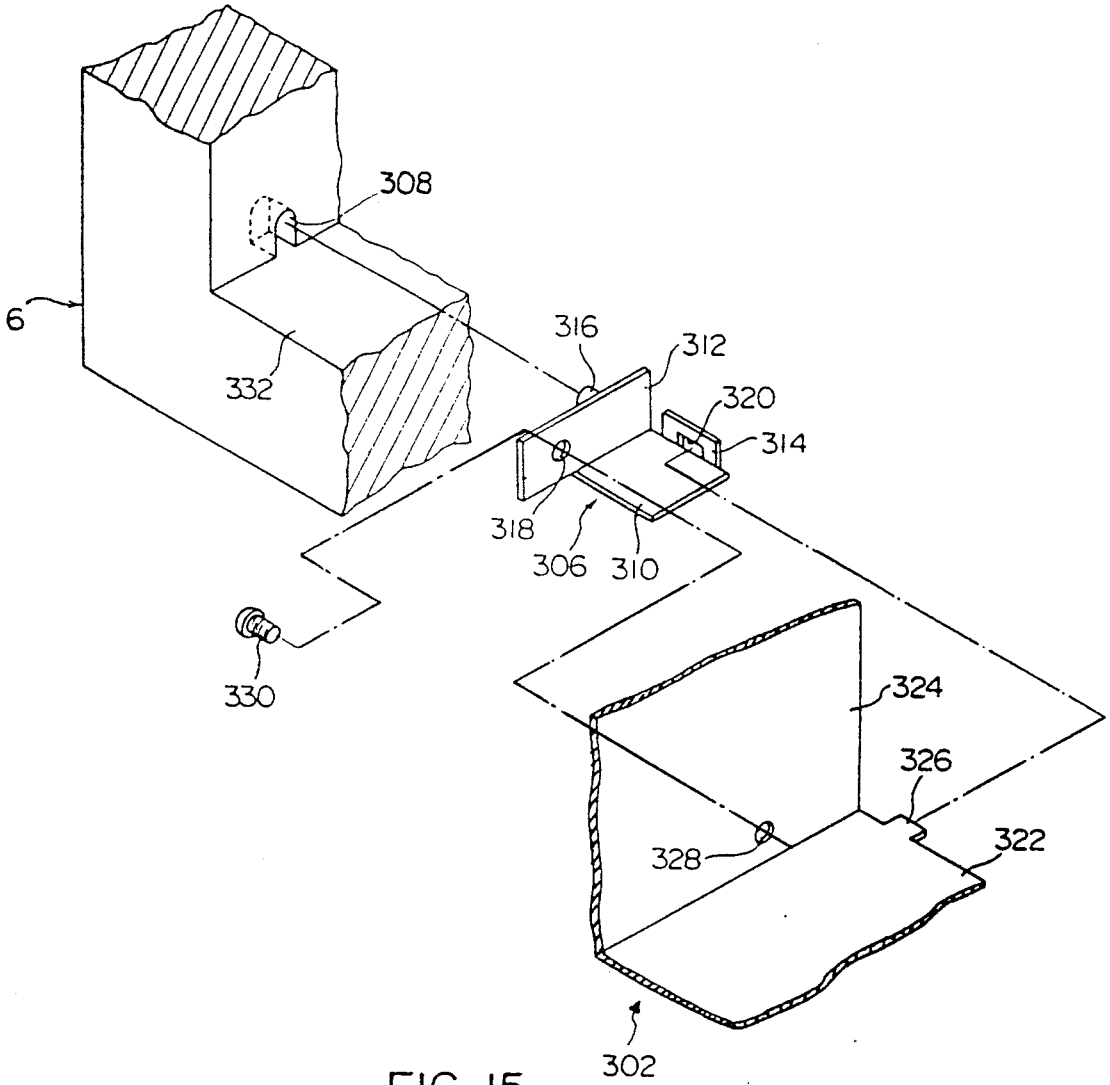
FIG. 15 is a partial exploded perspective view illustrating the manner of mounting a discharge unit.

To mount the discharge unit 302, a pair of fixtures 306 (only one of which is shown in FIG. 15) are secured to discharge opening portions defined in the left surface of the main body 2 of the apparatus, and then the discharge unit 302 is mounted on the fixtures 306. In the illustrated embodiment, a pair of receiving holes 308 (only one of which is shown in FIG. 15) are formed in the discharge opening portions of the main body 2. The fixtures 306 each have a rectangular horizontal supporting wall 310 and projecting walls 312 and 314 projecting vertically upwardly from the horizontal supporting wall 310. A cylindrical protrusion 316 and a circular hole 318 are provided in spaced-apart relationship in the projecting wall 312, and a rectangular hole 320 is formed in the other projecting wall 314. The discharge unit 302 has a bottom wall 322 and a pair of vertical plates 324 (only one of which is shown in FIG. 15) extending substantially vertically upwardly from the bottom wall 322, and a pair of rectangular protrusions 326 (only one of which is shown in FIG. 15) are provided at opposite end portions of the bottom wall 322. Internally threaded screw holes 328 are formed respectively in the vertical plates 324 (FIG. 15 shows only that screw hole 328 which is formed in one of the vertical plates 324). Because of this structure, the fixtures 306 are detachably mounted on the discharge opening portions of the main body 2 of the apparatus (in the mode of use shown in FIG. 1, the receiving plate 98 is mounted on the discharge opening portions) by positioning the horizontal supporting walls 310 on the upper surfaces 332 defining part of the discharge openings of the main body 2 and inserting the protrusions 316 into the receiving holes 308. Thereafter, by positioning the protrusions 326 of the bottom walls 322 of the discharge unit 302 within the holes 320 of the fixtures 306 and fitting a fixing screw 330 into the internally threaded screw hole 328 of the vertical plate 324 through the hole 318 of the projecting wall 312, the discharge unit 302 is secured to the main body 2 of the machine through the fixtures 306.

Figure 16:
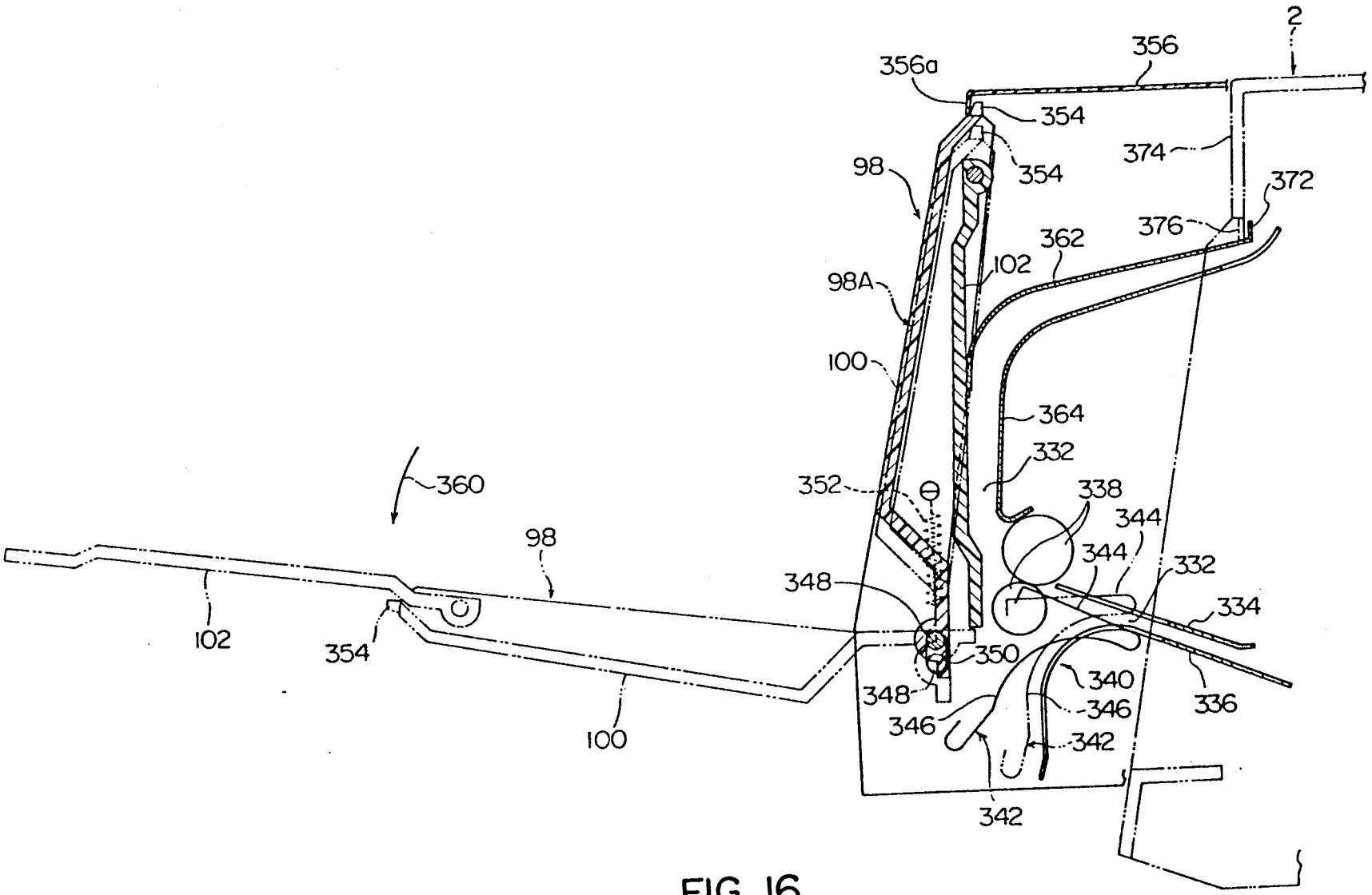
FIG. 16 is a sectional view showing the discharge unit.

The structure of the discharge unit 302 is described below. With reference to FIG. 16 together with FIG. 14, the illustrated discharge unit 302 is provided with a third discharge passage 332 for conducting a sheet material delivered from the first discharge roller pair 110 further to a downstream side. The upstream portion of the third discharge passage is defined by a pair of guide plates 334 and 336 and a third discharge roller pair 338. Its upstream end communicates with a conveying passage defined in the main body 2 of the machine. Discharge direction changing means 340 is disposed between the pair of guide plates 334 and 336 and the third discharge roller pair 338. The guide plate 334 extends in a straight line from the first discharge roller pair 110 toward the third discharge roller pair 338. The guide plate 336 extends in a straight line from the first discharge roller pair 110 toward the third discharge roller pair 338, and then curves downwardly. The discharge direction changing means 340 in the illustrated embodiment includes a changing member 342 which is selectively brought to a first position shown by a solid line in FIGS. 14 and 16 (the position shown also in FIG. 17) and a second position shown by a two-dot chain line in FIGS. 14 and 16. The changing member 342 has a first guide portion 344 extending in a straight line and a second guide portion 346 extending downwardly in a curving fashion from one end of the first guide portion 344 and is adapted to be held selectively at a first and a second position by actuating means (not shown) such as an electromagnetic solenoid. When the changing member 342 is at the first position, the first guide portion 344 extends in a straight line from the straight line portion of the guide plate 336 and therefore, further conducts a sheet material conveyed between the guide plates 334 and 336 to the third discharge roller pair 338 located downstream. On the other hand, when the changing member 342 is at the second position, the second guide portion 346 extends curvingly from above the guide plate 334 to below it, and therefore, conducts the sheet material conveyed between the guide plates 334 and 336 downwardly through the curving portion of the guide plate 336 branching from the third discharge passage 332 and then through the second guide portion 346.

As shown in FIG. 16, the receiving plate 98 used in the mode of use shown in FIG. 1 is detachably secured to the discharge unit 302 by fitting protrusions 348 provided at both ends of the base portion of the first plate 100 into receiving holes 350 in such a manner that they are free to move vertically (FIG. 16 shows only one protrusion 348 and one receiving hole 350). A biasing spring 352 for elastically biasing the receiving plate 98 upwardly is interposed between the receiving plate 98 and part of the discharge unit 302. The receiving plate 98 can be used in the same manner as in FIG. 1, and when it is at a storage position shown by a solid line in FIG. 16 (at this time, the second plate 102 is held at a storage portion), it extends upwardly in a nearly vertical direction, and the outside surface of the first plate 100 defines part of the housing of the discharge unit 302. In this state, the receiving plate 98 is biased upwardly by the action of the biasing spring 352, and held at an elevated position shown by a solid line in FIG. 16 as a result of the protrusions 348 coming into contact with the upper ends of the receiving holes 350. At the elevated position, an engaging projecting piece 354 provided at the end of the first plate of the receiving plate 98 is positioned inwardly of a downwardly extending portion 356*a* in an upper wall 356 of the discharge unit 302 Thus, as the engaging projecting piece 354 comes into contact with the downwardly extending portion 356*a*, the receiving plate 98 is accurately prevented from pivoting in the direction shown by an arrow 360 from the above storage position. The receiving plate 98 can be brought to a receiving position shown by a two-dot chain line in FIG. 16 (the second plate 102 is also brought to an operating position from the storage position) by pushing down the receiving plate 98 as shown by the two-dot chain line 98A (FIG. 16) against the biasing action of the biasing spring 352 and then pivoting it in the direction shown by arrow 360.

In the illustrated embodiment, the downstream side portion of the third discharge passage 332 extend upwardly in a curving fashion from the third discharge roller pair 338. Its one side (the left side in FIGS. 14 and 16) is defined by the receiving plate 98 (particularly the second plate 102) and an opening-closing guide plate 362 which is freely openable and closable as will be described below, and its other side (the right side in FIGS. 14 and 16) is defined by a guide plate 364. It will be understood from FIG. 14 that when the receiving plate 98 is held at the receiving position, the sheet material from the third discharge roller pair 338 is discharged directly onto the receiving plate 98, but that when the receiving plate 98 is held at the storage position, the sheet material from the third discharge roller pair 338 passes between the receiving plate 98 (particularly, the second plate 102) and the guide plates 362 and 364, and is fed upstream of the second discharge roller pair 122, and by the action of the second discharge roller pair 122, it is discharged onto the inclined upper surface 112*a* of the main body 2 of the machine.

Figure 17:
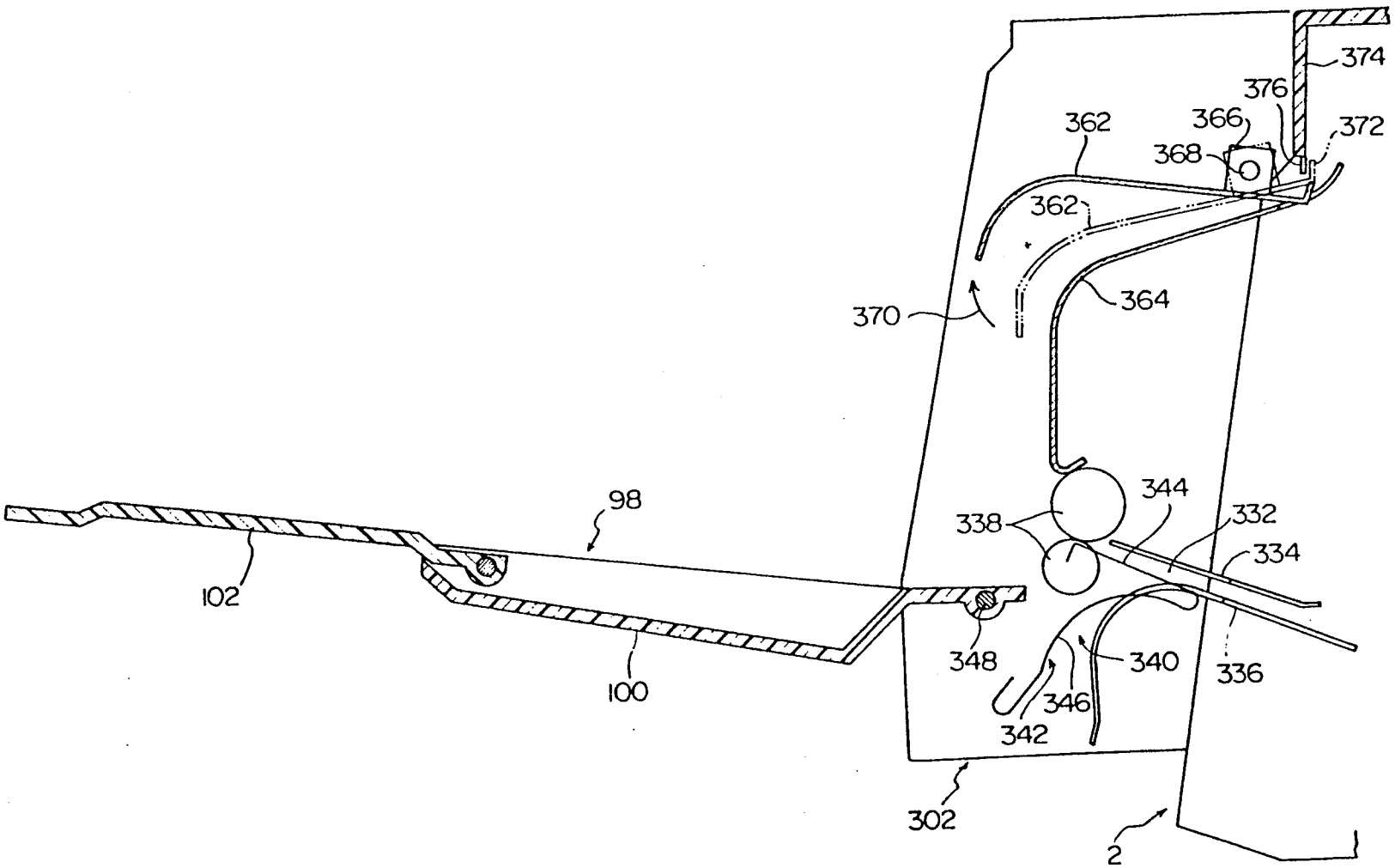
FIG. 17 is a view for illustrating the opening-closing operation of an opening-closing guide plate in the discharge unit.

In the illustrated embodiment, the downstream side portion of the third discharge passage 332 can also be opened. With reference mainly to FIG. 17, a plate piece 366 is fixed to the upper end portion of the opening-closing guide plate 362, and mounted pivotally between the vertical plates 324 (only one of which is shown in FIG. 15) of the discharge unit 302 via a shaft member 368. Accordingly, as shown in FIG. 17, the downstream side portion of the third discharge passage 332 can be opened sufficiently to a great extent by holding the receiving plate 98 at the receiving position as described above and then pivoting the opening-closing guide plate 362 upwardly in a direction shown by an arrow 370. As a result, in the event of paper jamming at this part, the sheet material that has jammed up can be removed very easily. The opened third discharge passage 332 can be returned to the original state by pivoting the receiving plate 98 (the second plate 102 is held at the storage position and stored in the first plate 100) to the storage position from the receiving position. When the receiving plate 98 is so pivoted, the inside surface of the receiving plate 98 (the right surface of the second plate 102 in FIG. 16) acts on the lower end portion of the opening-closing guide plate 362 to pivot it counterclockwise in FIGS. 16 and 17. When the receiving plate 98 is thus pivoted to the storage position, the opening-closing guide plate 362 is pivoted to a closing position shown by a two-dot chain line as shown in FIGS. 16 and 17 by the action of the receiving plate 98. As a result, the receiving plate 98 and the guide plate 362 define one side of the downstream end portion of the third discharge passage 332. At this opening position, the pivoting movement of the opening-closing guide plate 362 beyond the closing position is accurately hampered when a flexed portion 372 provided at the upper end of the opening-closing guide plate 362 is positioned inwardly of a downwardly extending portion 376 extending from part of a side wall 374 in the main body 2 of the machine and abuts with the downwardly extending portion 376. Accordingly, by a very simple operation of positioning the receiving plate 98 at the above-mentioned storage position, the guide plate 362 can also be held at the closing position, and by the action of the receiving plate 98 present at the storage position, the guide plate 362 can also be accurately held at the closing position.

Now, the auxiliary unit 304 will be described with reference mainly to FIG. 14. The illustrated auxiliary unit 304 is provided with an introduction passage 380, a reversal holding portion 382, a return passage 384 and a receiving-feeding means 386. In the illustrated embodiment, the rear end portion of the auxiliary unit 304 loaded in the cassette-receiving section 88 projects to the left in FIG. 14 from the cassette-receiving section 88, and on the upper surface of the projecting portion of the auxiliary unit 304, an introduction opening 390 is defined opposite to a refeeding discharge opening 388 defined in the under surface of the discharge unit 302. The introduction passage 380 is defined by the lower portion of a guide plate 392 and a guide plate 394, and extends to the left in FIG. 14 from the introduction opening 390. The reversal holding portion 382 is comprised of part of the guide plate 392, a guide plate 396 and the lower portion of a guide plate 398, and a pair of feed rollers 397 are disposed between the guide plate 392 and the guide plate 396. The reversal holding portion 382 extends to the left in FIG. 14 from the downstream end of the introduction passage 380, further curves downwardly in an arcuate form, and thereafter extends to the right in FIG. 14. The return passage 384 is defined by the guide plate 394 and the upper portion of the guide plate 398 and extends to the right in FIG. 14 from the upstream end of the reversal holding portion 382. The receiving-refeeding means 386 includes a plate-like receiving member 400 extending nearly horizontally, a guide plate 402 disposed above the receiving member 400, and a transfer means 403 acting on the sheet material existing on the receiving member 400 through an opening formed in the receiving member 400. The feed roller 218 disposed in the cassette-receiving section 88 and a roller 404 which is disposed in the auxiliary unit 304 and cooperates with the feed roller 218 through the opening formed in the receiving member 400 act as feed means for delivering a sheet material received in the receiving member 400 toward the second feed passage 96.

Further provided in the auxiliary unit 304 are a first detecting means 406, a second detecting means 408 and a third detecting means 410. These detecting means 406, 408 and 410 may be comprised of a mechanical switch or an optical switch. The first detecting means 406 disposed near the intersecting portions of the introduction passage 380, the reversal holding portion 382 and the return passage 384, and detects the sheet material conveyed through the introduction passage 380. The second detecting means 408 is disposed in the downstream end portion of the reversal holding portion 382, and detects a sheet material that has been introduced into the reversal holding portion 382. The third detecting means 410 is disposed in the front end portion of the receiving member 400, and detects a sheet material that has been received in the receiving member 400. A sheet material, which swerves from the third discharge passage 332 by the action of the changing member 342 at the second position, is discharged from the re-feeding discharge opening 388 and then introduced through the introduction opening 390 of the auxiliary unit 304, is re-fed in the following manner to the conveying passage defined in the main body 2 of the machine. When the sheet material introduced through the introduction opening 390 is conveyed through the introduction passage 380 to its downstream end portion, it is detected by the first detecting means 406. As a result, a feed roller pair 397 is energized and rotated in the direction shown by an arrow, and the sheet material passing through the introduction passage 380 and introduced into the reversal holding portion 382 is fed further downstream by the action of the feed roller pair 397. When the leading end portion of the sheet material is fed to the second detecting means 408, the second detecting means 408 detects it (in this state, the trailing end of the sheet material has gone past the guide plate 394 and is located between the guide plates 392 and 398, and its trailing end portion is nipped by the feed roller pair 397). As a result, the rotation of the feed roller pair 397 is reversed by the detection signal from the second detecting means 408, and the sheet material held by the reversal holding portion 382 by the action of the feed roller pair 397 rotating in a direction opposite to the direction shown by arrow is reversed in advancing direction and introduced into the return passage 384 with its trailing end frontward. It passes through the return passage 384 and is conducted to the receiving member 400 of the receiving-refeeding means 386. The sheet material conducted onto the receiving member 400 is again transferred by the action of the transfer means 403 in the feeding direction shown by an arrow 412 between the receiving member 400 and the guide plate 402. When the sheet material is transferred to a predetermined position, the third detecting means 410 detects the sheet material, and by the detection signal from the third detecting means 410, the transfer means 403 is deenergized. Thus, the sheet material is received at a predetermined position on the receiving member 400. When thereafter the feed roller 218 is rotated in the direction of the arrow, the action of the feed rollers 218 and 404 cooperating with each other delivers it from the receiving-refeeding means 386, and the delivered sheet material is again fed into the conveying passage via the second feed passage 96. It will be easily understood from FIG. 14 that when the sheet material is thus re-fed, the image-bearing surface of the sheet material faces downwardly and the sheet material is again conveyed through the conveying passage with its image-bearing surface down. During this conveyance, an image is formed on the other surface.

Figure 18:
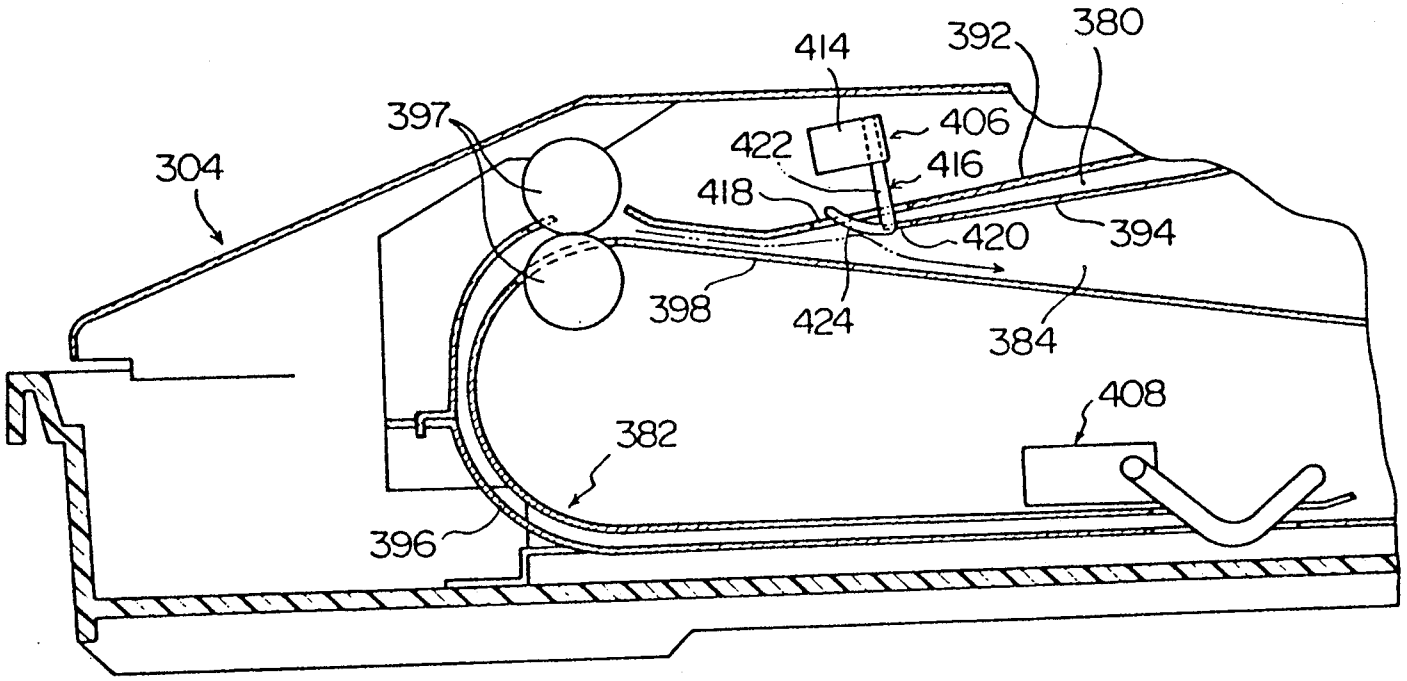
FIG. 18 is a sectional view for showing the essential parts of an auxiliary unit for both surfaces.
Figure 19:
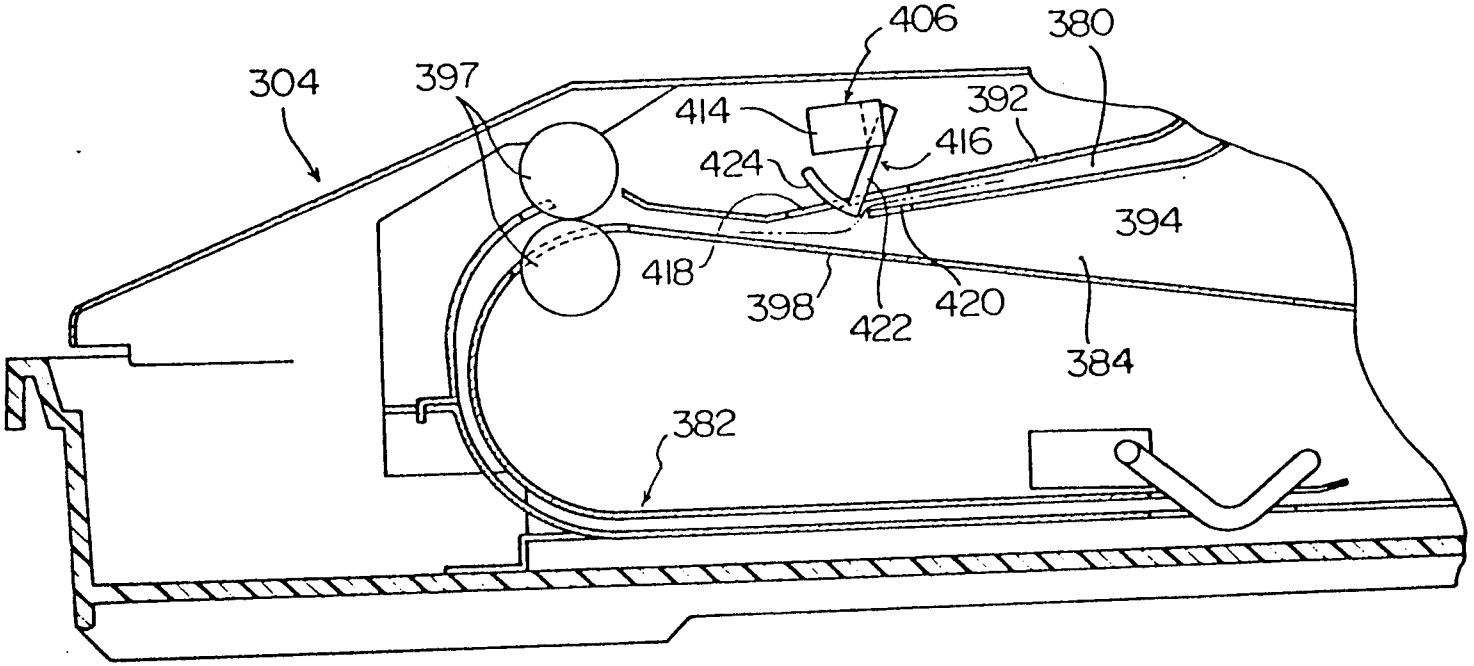
FIG. 19 is a sectional view, corresponding to FIG. 18, showing the state in which a first detection means has detected a sheet material.
Figure 20:
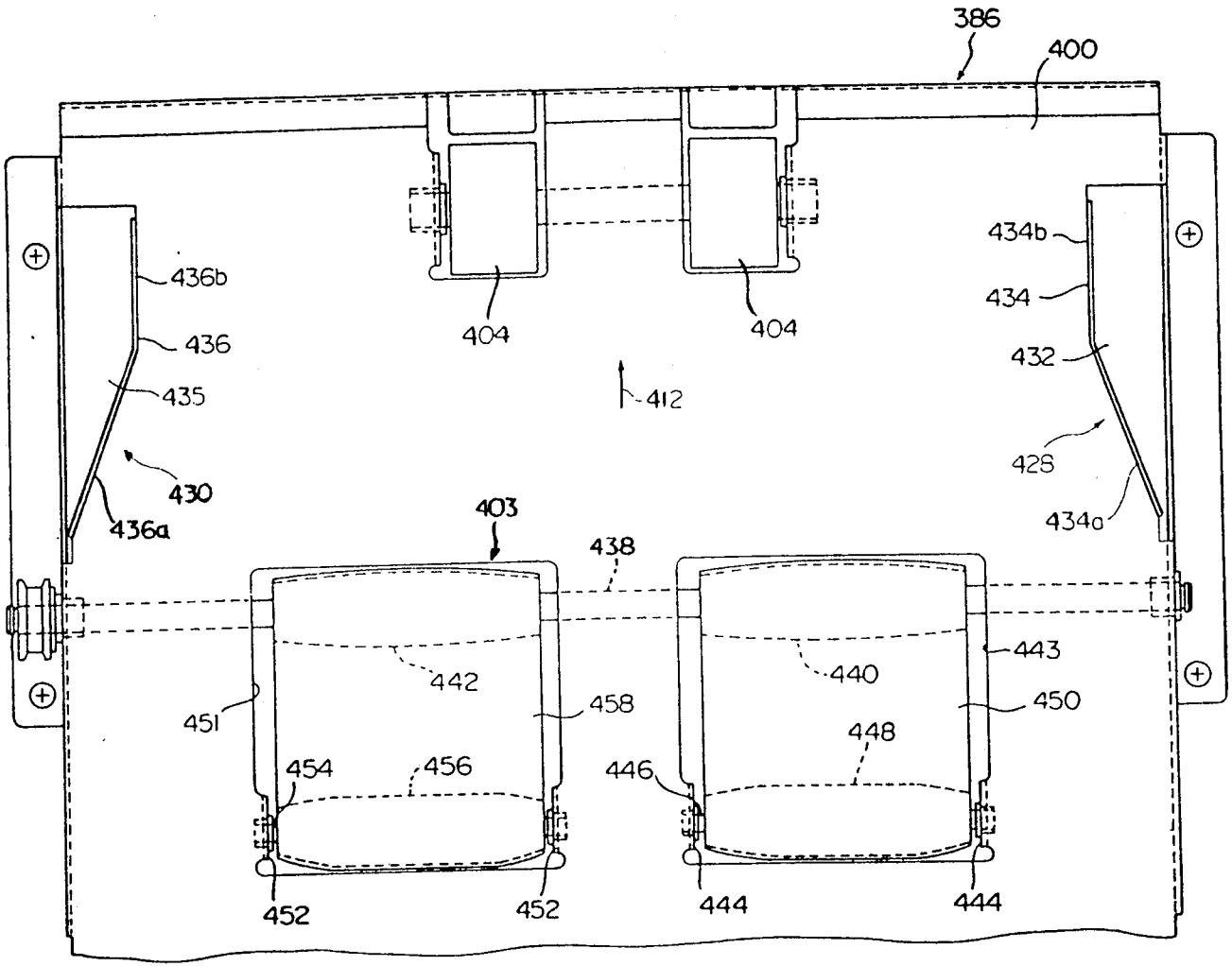
FIG. 20 is a top plan view showing receiving-refeeding means in the auxiliary unit.

The auxiliary unit 304 for image formation on both surfaces is constructed as shown in FIGS. 18 and 19 with regard to the first detecting means 406 and in FIG. 20 with regard to the receiving-refeeding means 386. In FIGS. 18 and 19, the illustrated first detecting means 406 includes a switch body 414 and a detecting arm portion 416 extending from the switch body 414. The switch body 414 is disposed above the guide plate 392, and the detecting arm 416 projects into the downstream end portion of the introduction passage 380 through an opening 418 formed in the guide plate 392, and across the introduction passage 380, is positioned in a recess 420 formed in the downstream end of the guide plate 394. In the illustrated embodiment, the detecting arm 416 has a detecting portion 422 extending in a straight line toward the recess 420 of the guide plate 394 from the switch body 414 and a guide portion 424 extending in an arcuate form slightly upwardly toward the reversal holding portion 382 from the lower end of the detecting portion 422. The free end of the guide portion 424 projects upwardly through the opening 392 of the guide plate 418. The detecting arm 416 can pivot clockwise from the non-detecting position shown in FIG. 18, but never pivots counterclockwise from the above position by the action of a stopper member (not shown).

Because of the above structure, the sheet material moving through the introduction passage 380 acts on the detecting portion of the detecting arm 416 as shown by an arrow indicated by a two-dot chain line in FIG. 19 to cause the detecting arm 416 to pivot clockwise from the non-detecting position shown in FIG. 18 to a position shown in FIG. 19. Thus, the first detecting means 406 turned on from the off-state and detects the sheet material. On the other hand, when the sheet material moving from the reversal holding portion 382 to the return passage 384 acts on the detecting arm 416 (at this time, it acts not on the detecting portion 422 but on the guide portion 424), the leading end of the sheet material is guided by the guide portion 424 of the detecting arm 416 and conducted to the return passage 384 as shown by an arrow indicated by a two-dot chain line in FIG. 18. Accordingly, the action of the guide member 424 of the detecting arm 416 accurately prevents the sheet material returned toward the returning passage 384 from coming into the introduction passage 380 between the guide plates 392 and 394. Consequently, the occurrence of paper jamming in the crossing part of the introduction passage 380, the reversal holding portion 382 and the returning passage 384 can be reduced.

Now, with reference to FIG. 20, the receiving-refeeding means 386 will be described. Widthwise positioning means 428 and 430 are provided on both side end portions respectively in the widthwise direction (a direction perpendicular to the sheet surface in FIG. 14 and the left-right direction in FIG. 20) of the receiving member 400 for positioning the width of the sheet material at a predetermined position. The positioning means 428 and 430 are composed of width restricting members 432 and 435 and disposed opposite to both end portions of the front portion (in the illustrated embodiment, the part between the transfer means 403 and the roller 404) of the receiving member 400. A restricting portion 434 projecting upwardly substantially vertically is provided in the inside end of one width restricting member 432

(the right one in FIG. 20). The restricting portion 434 has an inclined portion 434*a* extending in a straight line inwardly from one end (the upstream end in the feeding direction shown by arrow 412) toward the other portion and an extension 434*b* extending in a straight line in the feed direction from the downstream end of the inclined portion 434*a*. A restricting portion 436 projecting upwardly substantially vertically is further provided in the inside end of the other width restricting member 435 (the left one in FIG. 20). This restricting portion 436 has an inclined portion 436*a* extending inclinedly inwardly in a straight line from one end (the upstream end in the feeding direction shown by an arrow 412) toward the other end portion and an extension 436*b* extending in a straight line in the feed direction from the downstream end of the inclined portion 436*a*. The distance between the extension 434*b* of the width restricting member 432 and the extension 436*b* of the other width restricting member 435 corresponds to the width of the sheet material to be received in the receiving member 400. The transfer means 403 is provided with a rotating shaft 438 to be rotated in a predetermined direction. A pair of slender rollers 440 and 442 are mounted in axially spaced relationship on the rotating shaft 438. One roller 440 is positioned at one end portion of an opening 443 formed in one side portion of the receiving member 400, and opposite to the roller 406, a roller 448 is disposed in the other end portion of the opening 443. The roller 448 is mounted on a shaft member 446 rotatably supported between a pair of downwardly extending pieces 444 provided in the other end portion of the opening 443. An endless belt 450 is wrapped across the rollers 440 and 448, and the upper travelling section of the endless belt 450 is adapted to act on the sheet material on the receiving member 400 through the opening 443. The other roller 442 is positioned at one end portion of an opening 451 formed in the other side portion of the receiving member 400. Opposite to the roller 442, a roller 456 is disposed in the other end portion of the opening 451. The roller 456 is mounted on a shaft member 454 supported rotatably between a pair of downwardly extending pieces 452 provided in the other end portion of the opening 451. An endless belt 458 is wrapped across the rollers 442 and 456. The upper travelling section of the endless belt 548 is adapted to act on the sheet material on the receiving member 400 through the opening 451.

Because of the above structure, the sheet material conducted onto the receiving member 400 through the return passage 384 is further fed downstream by the action of the belts 450 and 458 of the transfer means 403 (the upper travelling sections of these belts 450 and 458 move in the feeding direction shown by arrow 412). When the leading end of the sheet material is fed to the positioning means 428 and 430, the sheet material undergoes the positioning action of the positioning means 428 and 430 and is further fed downstream. For example, if the sheet material is slightly deviated to the right (or left) in FIG. 20, its right front end portion (or its left front end portion) comes into contact with the inclined portion 434*a* (or 436*a*) of the positioning means 428 (or 430). By the positioning action of the inclined portion 434*a* (or 436*a*), the sheet material is moved inwardly, i.e. to the left (or right) in FIG. 20 with its movement in the feeding direction shown by arrow 412. As a result, the leading end of the sheet material is conducted to a site between the extensions 434*b* and 436*b* while being corrected in its widthwise position by the action of the inclined portions 434*a* and 436*a* of the positioning means 428 and 430. Thus, the widthwise position of the sheet material is matched with a predetermined position on the receiving member 400. Thereafter, the movement of the sheet material as above is stopped.

In order to position the sheet material as desired by the positioning means 428 and 430, the illustrated embodiment is further constructed as described below. Specifically, when the leading end portion of the sheet material undergoes the positioning action of the positioning means 428 and 430 (particularly the extensions 434*a* and 436*a*), the sheet material is not nipped by the roller pair in the image-forming machine. In the illustrated embodiment, the length in the feeding direction of a sheet material having the longest possible length usable in this image-forming machine is smaller than the distance from the upstream end in the feeding direction of the positioning means 428 and 430 (especially, the inclined portions 434*a* and 436*a*) to the nipping position of the feed roller pair 397. Hence, when the sheet material undergoes the positioning action of the positioning means 428 and 430, its trailing end portion can pass between the feed roller pair 397 and move freely in the widthwise direction. Accordingly, the widthwise portion of the sheet material can be corrected as required by the action of the positioning means 428 and 430.

In the illustrated embodiment, the transfer means 403 is constructed of the endless belts 450 and 458 wrapped across the rollers. Instead of this, it may be constructed of rollers adapted to be rotated in a predetermined direction. If the transferring power of the transfer means 403 alone is insufficient, pressing means for pressing the sheet material on the receiving member 400 against the belts 450 and 458 relatively weakly is preferably disposed above the upper travelling sections of the belts 450 and 458. The pressing means may be, for example, a ball rotatably in a desired direction or a relatively thin elastic film [(e.g., Lumilar (tradename)]. When the receiving member 400 is so constructed that the sheet material moves downstream by its own weight over the receiving member 400 (for example, by tilting the receiving member 400 in the required manner), the transfer means 403 may be omitted.

The mode of use shown in FIG. 14 further has the following characteristic features. Since the discharge unit 302 is mounted on the upper frame member 6 and the auxiliary unit 304 is mounted on the lower frame member 4, the apparatus does not lose the function of the shell-type supporting structure, and the upper frame member 6 can be pivoted between the opening and closing positions about the shaft member 5 as a center with respect to the lower frame member 4. Furthermore, since the relatively heavy auxiliary unit 304 is loaded detachably into the cassette-receiving section 88 of the lower frame member 4 and the discharge unit which is of a relatively simple structure and of light weight is secured to the upper frame member 6, the upper frame member 6 can be brought to the opening position relatively easily and the conveying passage in the main body of the machine can be opened even in the mode of use shown in FIG. 14. Furthermore, as can be seen from FIG. 14, when the upper frame member 6 is held at the opening position, the discharge unit 302 is moved upwardly as a unit with it. Accordingly, the space above the projecting portion of the auxiliary unit 304 which projects from the cassette-receiving section 88 is opened, and in the event of paper jamming near the introduction opening 390 of the auxiliary unit 304, the sheet material that has jammed up can be easily removed.

The structure which enables formation of images on both surfaces of the sheet material by using the discharge unit 302 and the auxiliary unit 304 can also be applied to the ordinary type of image-forming machine which is not provided with a shell-type supporting structure. This brings about the advantage that the function of an existing image-forming machine can be increased by adding relatively simple units.

We claim:

1. An image-forming machine comprising a main body having a receiving portion at its lower part and an image-forming means disposed at its upper part and being adapted to form an image on the surface of a sheet material by the action of the image-forming means while the sheet material is conveyed through a conveying passage, an auxiliary unit for both surface image-formation mounted detachably on the receiving portion of the main body, and a discharge unit mounted detachably on the discharge side the main body; wherein part of the auxiliary unit projects outwardly from the receiving portion and an introduction opening is defined in the upper surface of said part of the auxiliary unit projecting from the receiving portion, a discharge passage communicating with the conveying passage of the main body is defined in the discharge unit, a discharge direction changing means is disposed in the discharge passage for changing the discharge direction of the sheet material, and a discharge opening for re-feeding, opposite to the introduction opening of the auxiliary unit, is defined in the under surface of the discharge unit, and when the discharge direction changing means is at a first position, the sheet material conveyed through the conveying passage is diverted from the discharge passage and introduced into the auxiliary unit through the re-feeding discharge opening and the introduction opening, and when the discharge direction changing means is at a second position, the sheet material conveyed through the conveying passage is fed further downstream through the discharge passage without diverting.

2. The image-forming machine of claim 1 in which the main body of the machine is provided with a divisible structure comprised of a lower frame member and an upper frame member mounted on the lower frame member for free pivoting between an opening position and a closing position, the receiving portion is defined in the lower frame member, and the discharge unit is mounted on the upper frame member.

3. An image-forming machine comprising a conveying passage for conveying a sheet material through a transfer zone, a first discharge passage extending from the conveying passage, a second discharge passage extending from the first discharge passage, a first receiving means for receiving the sheet material with its image-bearing surface up, and a second receiving member for receiving the sheet material with its image-bearing surface down; wherein the first receiving means is comprised of a receiving plate which is free to pivot between a first position at which it extends nearly horizontally and a second position at which is extends nearly perpendicularly, when the receiving plate is at the first position, it receives the sheet material discharged from the first discharge passage, and when it is at the second position, it defines one side of the second discharge passage in cooperation with an opening-closing guide plate being free to pivot between a closing position at which it defines part of the second discharge passage and an opening position at which it opens said part, and when the receiving plate is held at the second position, the opening-closing guide plate is held at the closing position.

4. An image-forming machine comprising a main body adapted to form an image on one surface of a sheet material while it is conveyed through a conveying passage, and an auxiliary unit mounted on the main body; wherein the auxiliary unit is provided with an introduction passage for introducing the sheet material having an image formed on its one surface, a reversal holding portion for holding the sheet material conducted through the introduction passage, a receiving-refeeding means for receiving the sheet material and re-feeding the received sheet material toward the conveying passage, a return passage for conducting the sheet material held by the reversal holding portion into the receiving-refeeding means from the trailing end of the sheet material with its direction reversed, and a sheet detecting means disposed near the crossing point of the introduction passage, the reversal holding portion and the return passage, the sheet detecting means has a detecting arm portion projecting into the introduction passage, and the detecting arm portion has a detecting portion which acts on the sheet material to be fed to the reversal holding portion via the introduction passage and a guide portion which hampers the introduction of the sheet material from the reversal holding portion into the introduction passage.

5. An image-forming machine comprising a receiving-refeeding means for receiving a sheet material in which an image is formed on its one surface during conveyance through a conveying passage and re-feeding the received sheet material toward the conveying passage; wherein the receiving re-feeding means includes a receiving member for receiving the sheet material, a widthwise positioning means which acts on the sheet material returned toward a predetermined position of the receiving member and matches the widthwise position of the sheet material with said predetermined position, and a feed means for feeding the sheet material received at said predetermined position of the receiving member, and all of a plurality of roller pairs in the machine are arranged such that when the widthwise position of the sheet material is modified by the widthwise positioning means, even a sheet material having a maximum usable length is not nipped by the roller pairs.

6. The image-forming machine of claim 5 in which an opening is formed in the receiving member, and a transfer means is provided which acts on the sheet material placed on the receiving member through the opening.

* * * * *